US006000386A

United States Patent [19]

Johnson et al.

[11] Patent Number: 6,000,386

[45] Date of Patent: Dec. 14, 1999

[54] TOY GUN WITH FLUID PULSATOR

[75] Inventors: Lonnie G. Johnson, Smyrna; John T. Applewhite, Atlanta, both of Ga.

[73] Assignee: Johnson Research & Development Company, Inc., Smyrna, Ga.

[21] Appl. No.: 09/175,107

[22] Filed: Oct. 19, 1998

Related U.S. Application Data

[63] Continuation-in-part of application No. 08/999,507, Dec. 29, 1997, which is a continuation-in-part of application No. 08/822,008, Mar. 24, 1997.

[51] Int. Cl.[6] ..... F41B 11/00

[52] U.S. Cl. ..... 124/69; 124/70; 124/71; 124/72; 124/73; 124/76; 42/54; 222/79; 222/400.8

[58] Field of Search ..... 124/69, 71, 72, 124/73, 76, 63, 70; 42/54; 222/79, 400.8

[56] References Cited

U.S. PATENT DOCUMENTS

| | | | |
|---|---|---|---|
| 1,713,432 | 5/1929 | Griggs | 46/86 |
| 2,023,124 | 12/1935 | Dickover | 46/86 |
| 2,147,003 | 2/1939 | Von Kozurik | 124/11 |
| 2,312,244 | 2/1943 | Feltman | 124/11 |
| 2,357,951 | 9/1944 | Hale | 124/11 |
| 2,654,973 | 10/1953 | Lemelson | 46/56 |
| 2,733,699 | 2/1956 | Krinsky | 124/13 |
| 2,927,398 | 3/1960 | Kaye et al. | 46/74 |
| 2,962,017 | 11/1960 | Horowitz et al. | 124/27 |
| 3,025,633 | 3/1962 | Kaye et al. | 46/74 |
| 3,121,292 | 2/1964 | Butler et al. | 46/74 |
| 3,218,755 | 11/1965 | Quercetti | 46/86 |
| 3,308,803 | 3/1967 | Walther | 124/13 |
| 3,365,838 | 1/1968 | Butler et al. | 42/54 |
| 3,397,476 | 8/1968 | Weber | 43/6 |
| 3,415,010 | 12/1968 | Belz | 46/241 |
| 3,510,980 | 5/1970 | Pippin, Jr. | 46/74 |
| 3,612,026 | 10/1971 | Vadas et al. | 124/11 |
| 3,943,656 | 3/1976 | Green | 46/74 |
| 3,962,818 | 6/1976 | Pippin | 46/74 |
| 4,022,350 | 5/1977 | Amron | 222/79 |
| 4,073,280 | 2/1978 | Koehn | 124/72 |
| 4,083,349 | 4/1978 | Clifford | 124/72 |
| 4,159,705 | 7/1979 | Jacoby | 124/63 |
| 4,223,472 | 9/1980 | Feket et al. | 46/44 |
| 4,411,249 | 10/1983 | Fogarty et al. | 124/64 |
| 4,446,213 | 5/1984 | Alberico et al. | 446/56 |
| 4,687,455 | 8/1987 | Sculatti | 446/52 |
| 4,757,946 | 7/1988 | Johnson | 239/99 |
| 4,890,767 | 1/1990 | Burlison | 222/78 |
| 4,897,065 | 1/1990 | Fertig et al. | 446/63 |
| 5,090,708 | 2/1992 | Gerlitz et al. | 273/310 |
| 5,188,557 | 2/1993 | Brown | 446/212 |
| 5,280,778 | 1/1994 | Kotsiopoulos | 124/73 |
| 5,280,917 | 1/1994 | Ortiz | 273/318 |
| 5,339,791 | 8/1994 | Sullivan | 124/73 |
| 5,343,849 | 9/1994 | Steer | 124/72 |
| 5,343,850 | 9/1994 | Steer | 124/64 |
| 5,349,938 | 9/1994 | Farrell | 124/73 |
| 5,370,278 | 12/1994 | Raynie | 222/175 |
| 5,373,832 | 12/1994 | D'Andrade | 124/69 |
| 5,398,873 | 3/1995 | Johnson | 239/99 |
| 5,413,514 | 5/1995 | Milligan | 446/36 |
| 5,415,152 | 5/1995 | Adamson et al. | 124/59 |
| 5,439,139 | 8/1995 | Brovelli | 222/79 |
| 5,497,758 | 3/1996 | Dobbins et al. | 124/73 |
| 5,586,545 | 12/1996 | McCaslin | 124/73 |
| 5,613,483 | 3/1997 | Lukas et al. | 124/73 |
| 5,673,679 | 10/1997 | Walters | 124/53.5 |
| 5,704,342 | 1/1998 | Gibson et al. | 124/73 |
| 5,769,066 | 6/1998 | Schneider | 124/75 |
| 5,771,875 | 6/1998 | Sullivan | 124/72 |

FOREIGN PATENT DOCUMENTS

2587911-A1 10/1985 France .

*Primary Examiner*—J. Woodrow Eldred
*Attorney, Agent, or Firm*—Kennedy, Davis & Hodge

[57] ABSTRACT

A fluid pulsator for a compressed gun (10) or water gun (30) is provided having a housing (604) with a fluid inlet (607) and a fluid outlet (608), an internal tube (605) reciprocally coupled to the housing, and a sealing member (606) reciprocally mounted to the internal tube. The housing and internal tube define a rearward pressure chamber (632) and a forward fluid pressure chamber (631). The fluid pulsator also has means for actuating the movement of the sealing member that can be manually manipulated to vary the actuation rate of the pulsator.

39 Claims, 17 Drawing Sheets

FIG 13
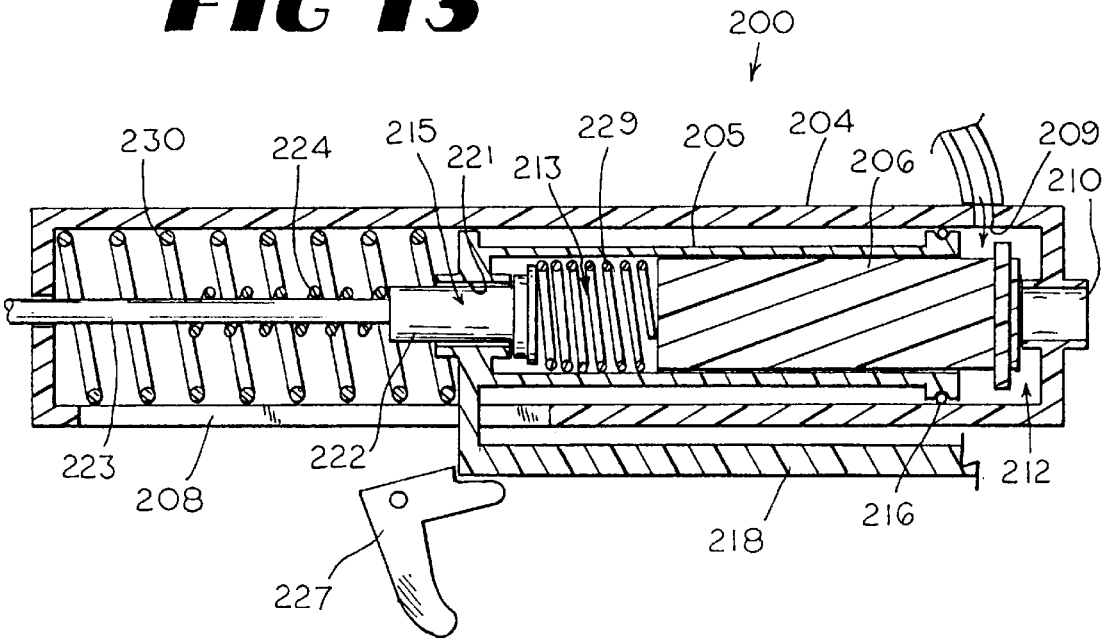
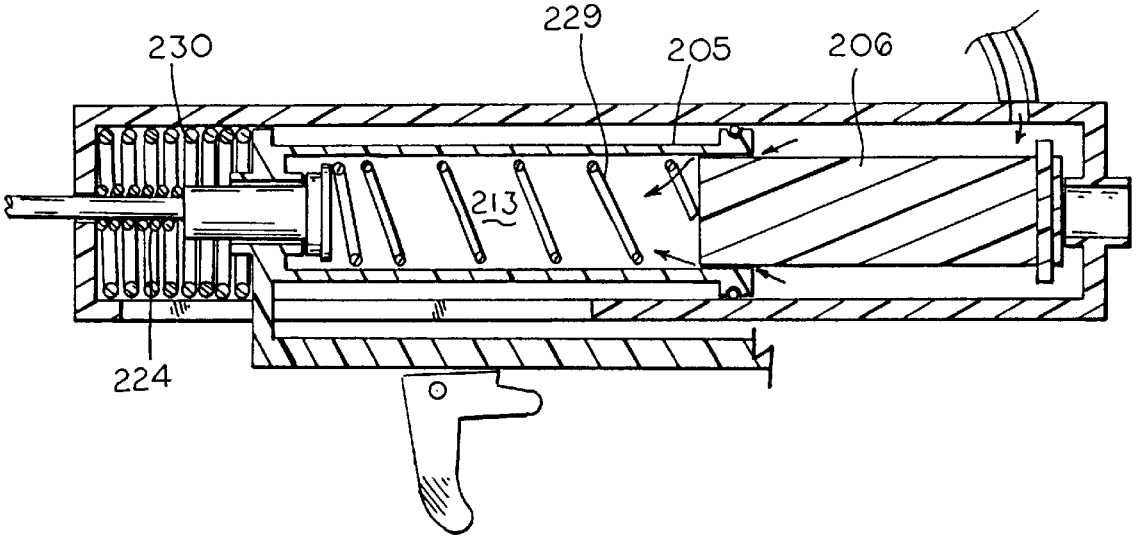
FIG 14

FIG 15
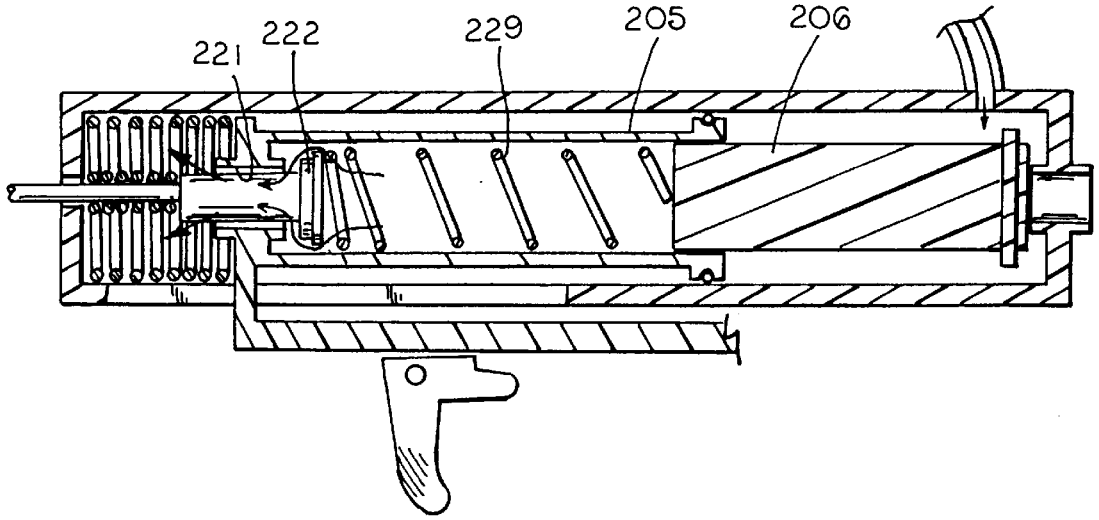
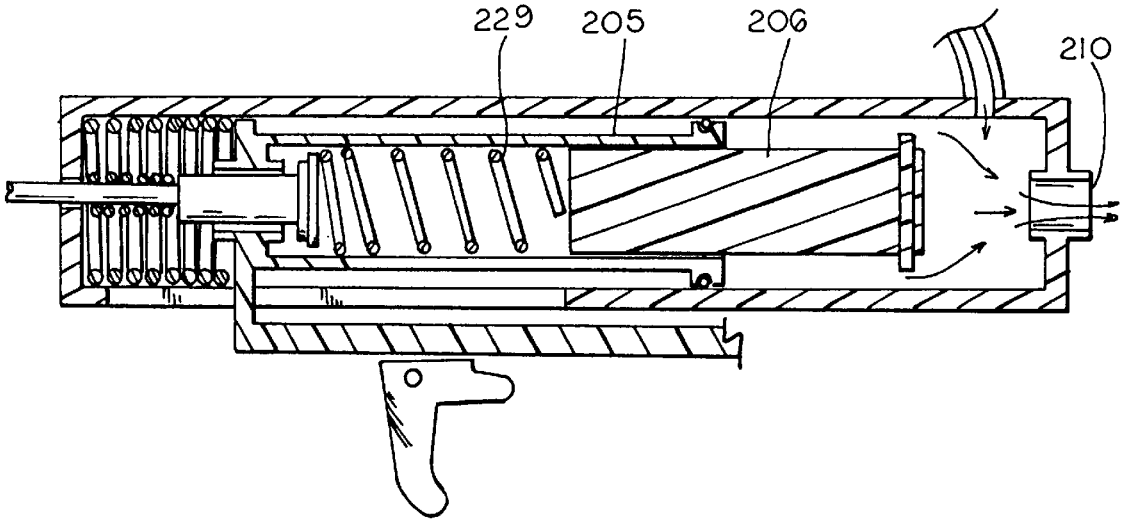
FIG 16

FIG 17
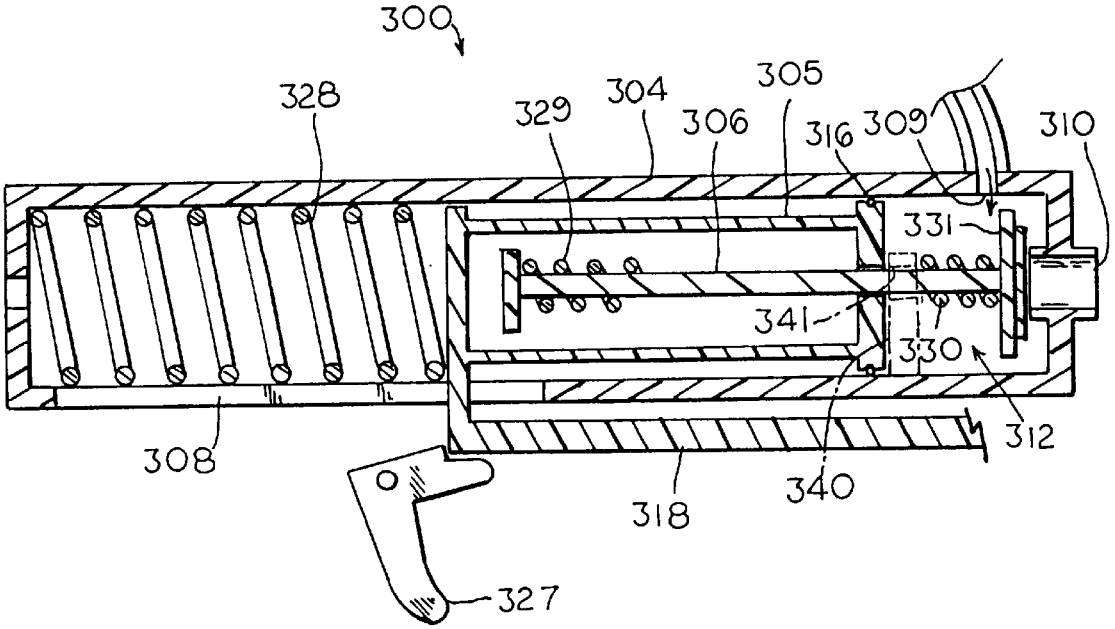
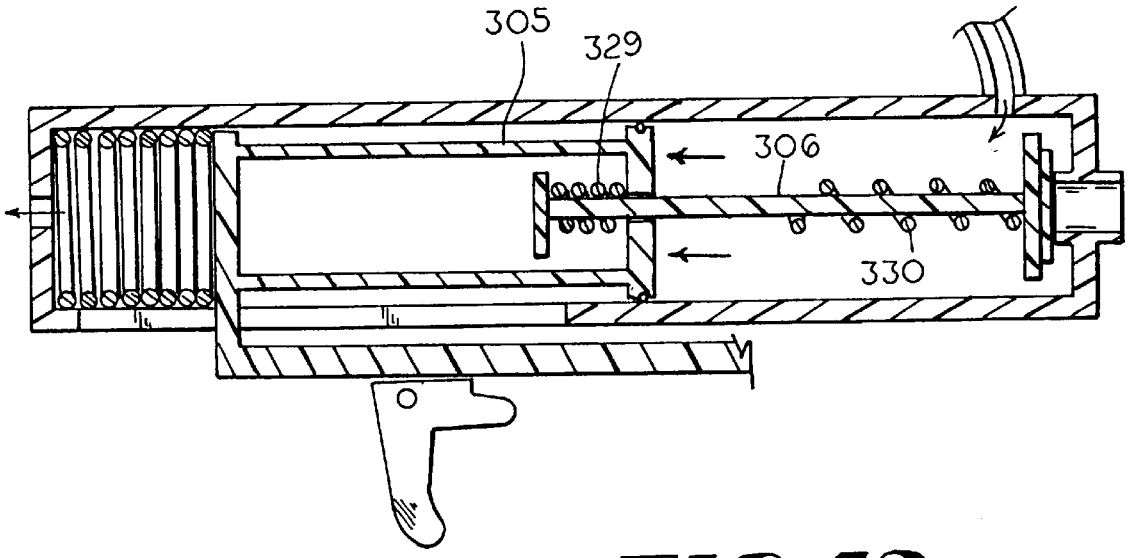
FIG 18

FIG 19
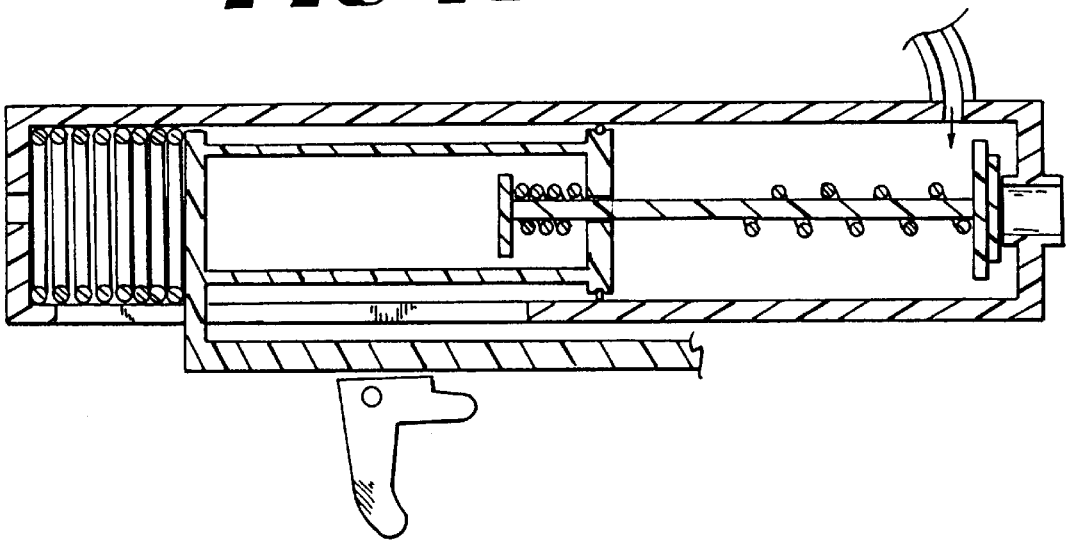
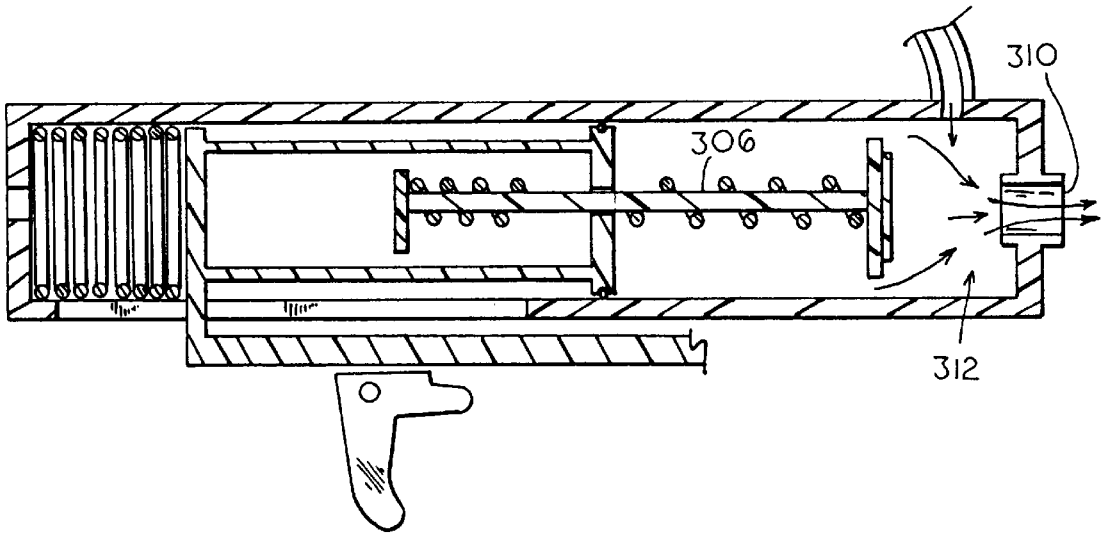
FIG 20

FIG 23
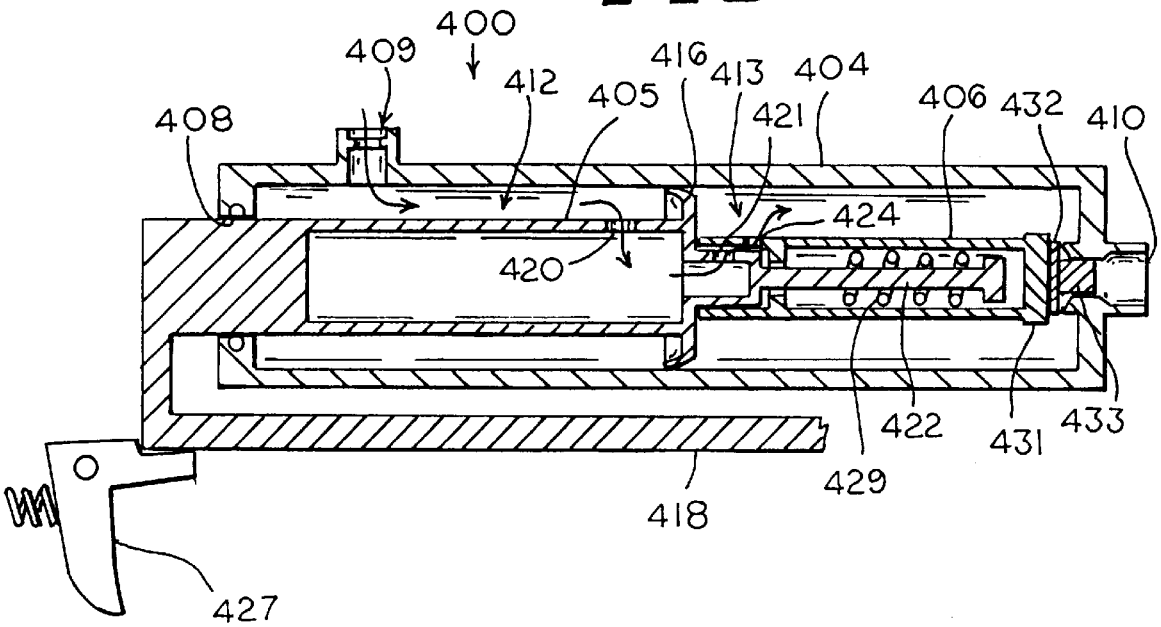
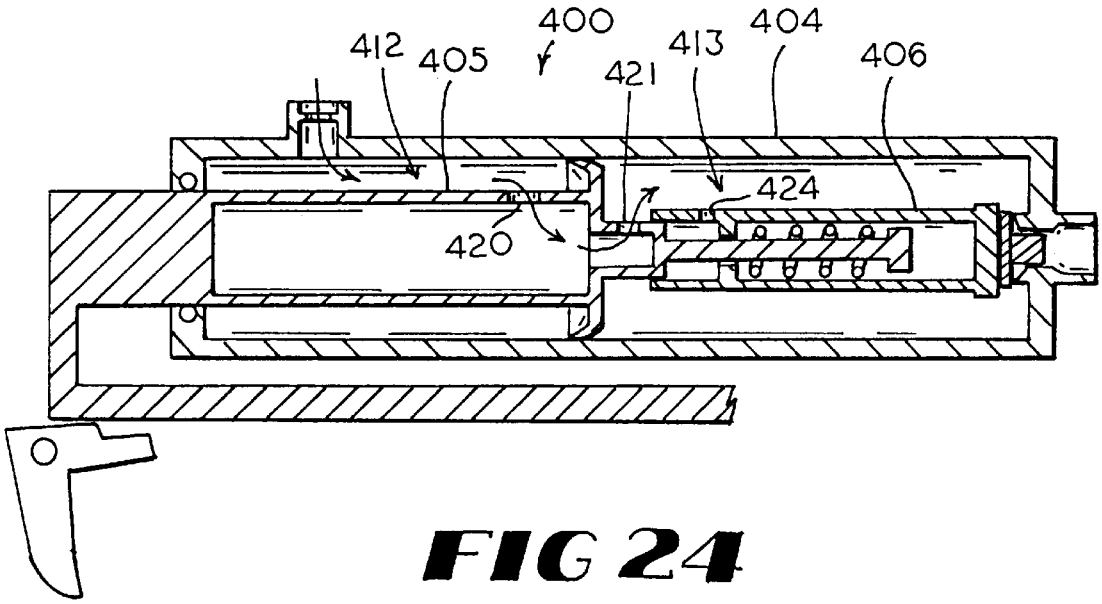
FIG 24

TOY GUN WITH FLUID PULSATOR

REFERENCE TO RELATED APPLICATION

This is a continuation-in-part of application Ser. No. 08/999,507 filed Dec. 29, 1997, pending which is a continuation-in-part of application Ser. No. 08/822,008 filed Mar. 24, 1997 pending.

TECHNICAL FIELD

This invention relates to fluid guns, and specifically to compressed air toy guns which include a magazine for holding projectiles and an indexer for indexing the magazine and to water guns which emit a pulsating stream of water.

BACKGROUND OF THE INVENTION

Toy guns which shoot or launch projectiles have been very popular for many years. These guns have been designed to launch projectiles in a number of ways. A common method of launching has been by the compression of a spring which propels the projectile upon its decompression or release, as, for example, with BB guns and dart guns. These guns however usually do not generate enough force to launch projectiles with great velocity.

Toy guns have also been designed which use compressed air to launch projectiles such as foam darts. These types of guns use a reciprocating air pump to pressurize air within a pressure tank. In use, a single dart is loaded and the pump is typically reciprocated several times with each firing of the gun. Therefore, the gun must be loaded and pumped with each firing as it is not capable of firing several darts in rapid sequence. The rapid firing of a gun may be desired for those playing a mock war or other type of competition.

Toy guns have also been designed which produce a stream of water and hence are commonly referred to as water guns. Most water guns shoot a steady or continuous stream of water. This however does not replicate a realistic look of a machine gun. Some water guns have been designed which produce an interrupted stream of water to simulate the appearance or action of a machine gun. These water guns typically produce the interrupted stream by temporarily blocking a continuous stream of water. This method of breaking a continuous stream however is inefficient and does not truly give the appearance of individual bursts of water.

Accordingly, it is seen that a need remains for a toy air gun which may be rapidly fired in sequence and for a toy water gun which may produce a rapid sequence of water bursts. It is to the provision of such therefore that the present invention is primarily directed.

SUMMARY OF THE INVENTION

In a preferred form of the invention a toy gun comprises a plurality of launch tubes in which a plurality of projectiles may be loaded, pressurized air means for providing a supply of pressurized air, and an air pulsator in fluid communication with the pressurized air means. The air pulsator has a tubular housing with an outlet in fluid communication with the launch tubes and a plunger mounted within the tubular housing. The plunger and the housing cooperating for reciprocal movement of the plunger relative to the housing between a forward position and a rearward position. The plunger has a sealing head in sealing engagement with the tubular housing which in combination with the tubular housing defines a rearward chamber and a forward chamber separated from each other by the plunger sealing head. The rearward chamber is in fluid communication with the pressurized air means. The pulsator also has a movable seal coupled to the plunger for reciprocal movement between a sealing position sealing the housing outlet and an unsealing position unsealing the housing outlet, adjustable actuation means for adjustably actuating the movement of the movable seal from the sealing position to the unsealing position in response to the movement of the plunger a select distance relative to the housing, and biasing means for biasing the plunger towards its forward position. With this construction pressurized air flowing into the forward chamber causes the plunger to move away from the housing outlet towards its rearward position and against the biasing force of the biasing means and whereby the movement of the plunger a select distance determined by the adjustable actuation means causes the moveable seal to move to its unsealing position thereby allowing the pressurized air within the forward chamber to escape through the housing outlet, and whereby the release of pressurized air within the forward chamber allows the biasing force of the biasing means to move the plunger to its forward position thereby forcing the moveable seal back to its sealing position.

BRIEF DESCRIPTION OF THE DRAWINGS

FIGS. 13–16 are a sequence of side views, shown in partial cross-section, of a portion of the interior components of the air gun of FIG. 12, which show in sequence, the actuation of the interior components controlling the release of pressurized air.

FIGS. 17–20 are a sequence of side views, shown in partial cross-section, of a portion of the interior components in another preferred embodiment, which show in sequence, the actuation of the interior components controlling the release of pressurized air.

FIGS. 23–26 are a sequence of side views, shown in partial cross-section, of a portion of the interior components in another preferred embodiment, which show in sequence, the actuation of the fluid pulsator controlling the release of pressurized fluids.

DETAILED DESCRIPTION

Figure 1:
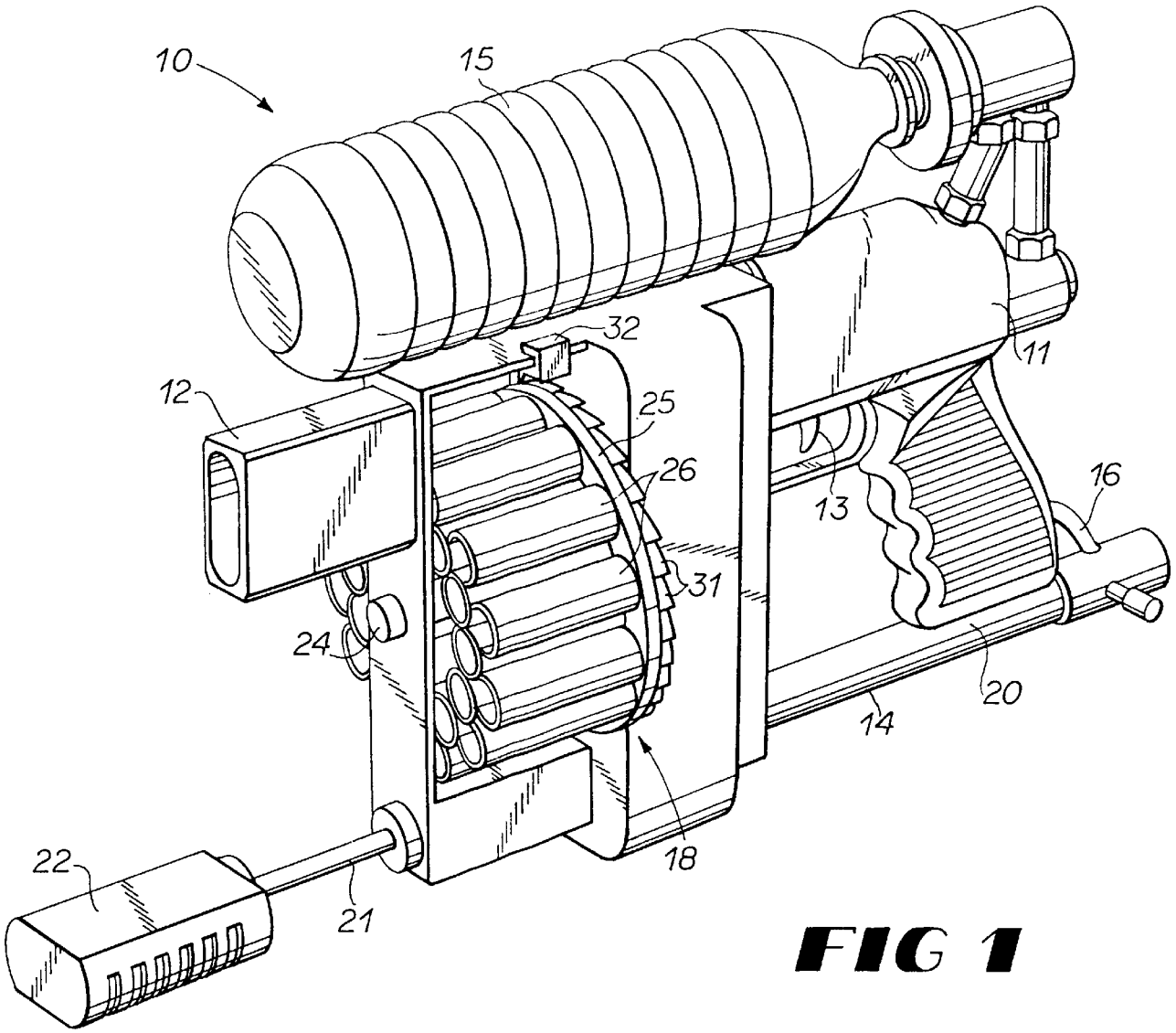
FIG. 1 is a perspective view of a rapid fire compressed air gun embodying principles of the present invention in a preferred form.

With reference next to the drawings, there is shown a compressed air gun 10 having a stock or handle 11, a barrel 12 mounted to the stock 11, a spring biased trigger 13, and a manual air pump 14. The gun 10 has a pressure chamber or tank 15 in fluid communication with the air pump 14 through a pressure tube 16 and a multi-projectile magazine 18 rotationally mounted to stock 11. The pump 14 includes a conventional cylinder 20, a cylinder rod 21 and a handle 22 mounted to an end of the cylinder rod 21.

Figure 2:
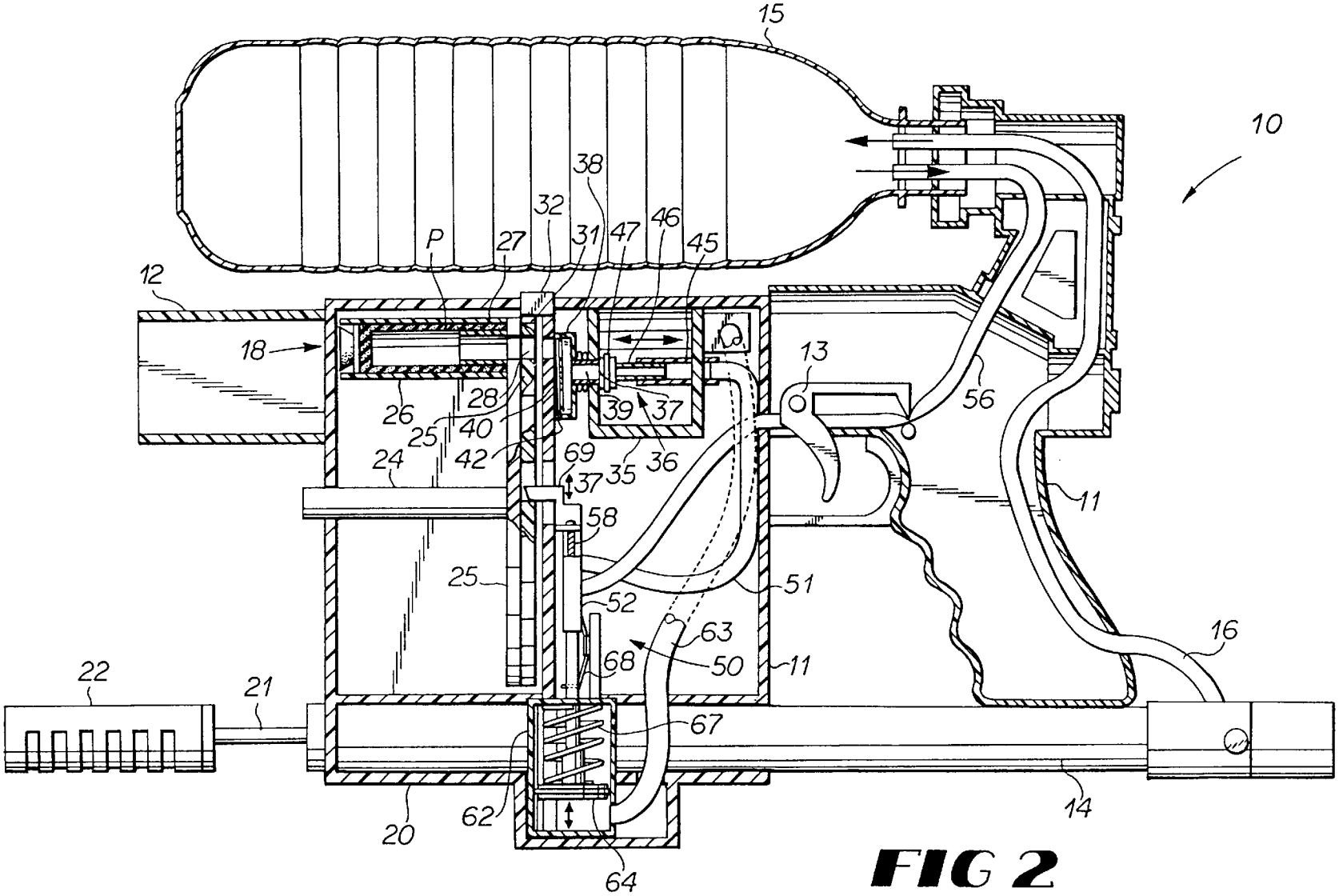
FIG. 2 is a side view, shown in partial cross-section, of the air gun of FIG. 1.
Figure 3:
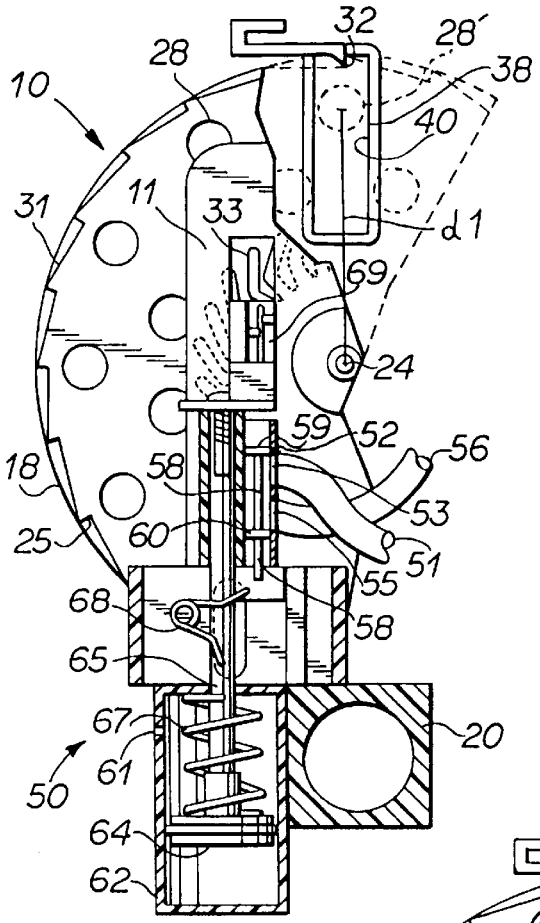
FIGS. 3–5 are a sequence of views showing a portion of the air gun of FIG. 1, which show in sequence, the actuation of an actuator which indexes a magazine and controls a release valve.
Figure 4:
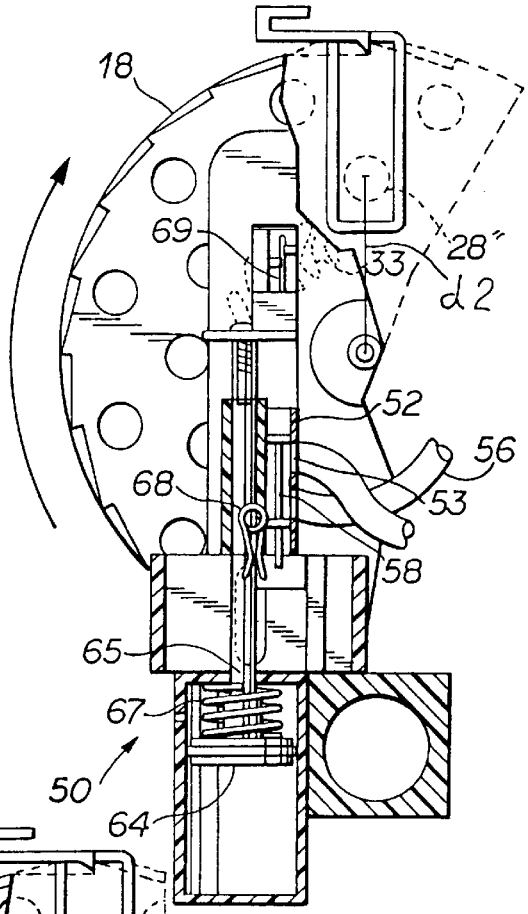
Figure 5:
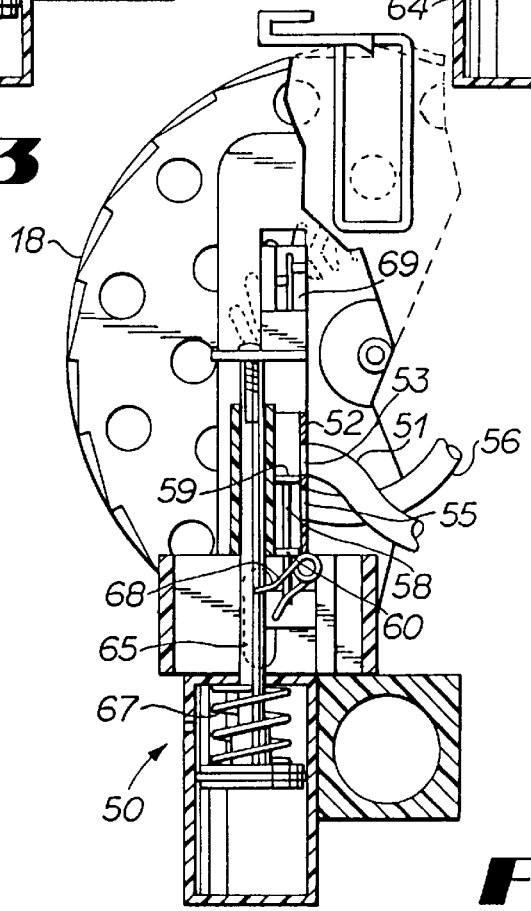
Figure 6:
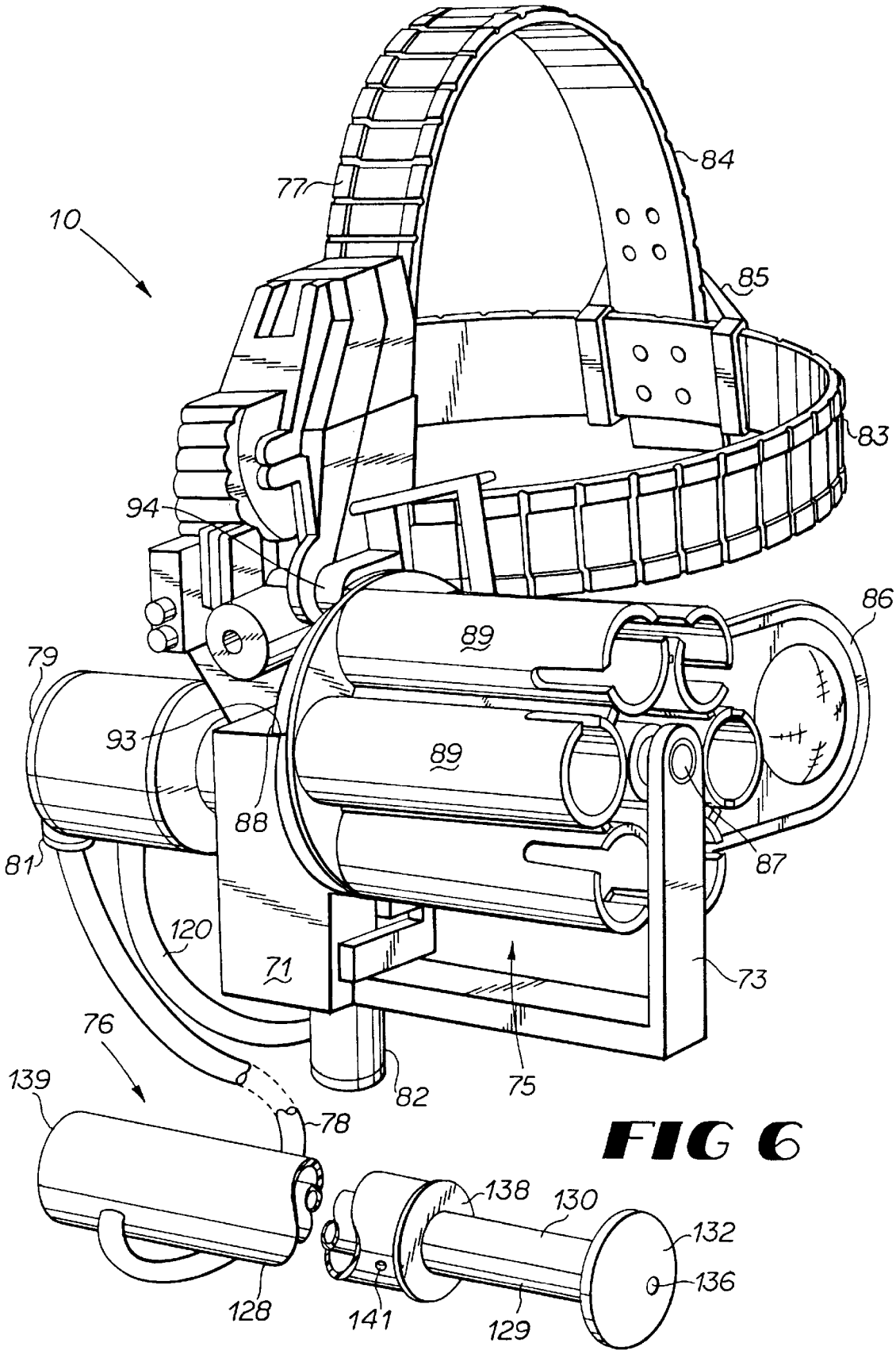
FIG. 6 is a perspective view of a rapid fire compressed air gun embodying principles of the present invention in another preferred form.

The magazine 18 has a central pivot rod 24 mounted to a disk-shaped mounting plate 25 and an annular array of projectile barrels 26 extending from the mounting plate 25 in generally two concentric circles about pivot rod 24. Each barrel 26 has a launch tube 27 therein aligned with an opening 28 extending through the mounting plate 25. Likewise, the openings 29 are oriented in two concentric circles or annular arrays with each opening of the inner circle being positioned generally between two adjacent opening of the outer circle, so as to appear in staggered fashion, as best shown in FIGS. 3–5. Thus, each opening 28' of the outer annular array of openings 28' is aligned along a radius and spaced a selected distance dl from the center of the mounting plate, and each opening 28" of the inner annular array of openings 28" is aligned along a radius and spaced a selected distance d2 from the center. The gun magazine is shown in FIG. 2 as having only one barrel for clarity of explanation. Mounting plate 25 has series of peripheral, outwardly extending, serrated teeth 31 each of which is aligned with a barrel 26. The serrated teeth 31 are configured to cooperate with a pawl 32 extending from the stock 11. The mounting plate 25 also has an annular array of L-shaped grooves 33 equal in number to the number of magazine barrels 26.

The gun 10 has a pressure chamber 35 adapted to receive and store a supply of air at elevated pressure levels and a pressure sensitive release valve 36 mounted within the pressure chamber 35. The pressure chamber 35 has an exit opening 37 therein. A spring biased sealing plate 38 is mounted within opening 37. The sealing plate 38 has a central bore 39 extending into an elongated bore 40 configured to overlay the mounting plate openings 28. It should be noted that the mounting plate openings 28 are positioned so that the sealing plate elongated bore 40 overlaps only one opening 28 at a time. A gasket 42 is mounted to the sealing plate 38 to ensure sealing engagement of the sealing plate with the mounting plate 25. The release valve 36 has a cylindrical manifold 45 and a cylindrical plunger 46 slidably mounted within manifold 45. Plunger 46 has a gasket 47 to ensure sealing engagement of the plunger about opening 37.

The release valve manifold 45 is pneumatically coupled to an actuator 50, by a pressure tube 51 extending therebetween the actuator 50 automatically and sequentially causes the actuation of the release valve 36. Actuator 50 includes an elongated manifold 52 having an upper opening 53 in fluid communication with pressure tube 51 and a lower opening 55 in fluid communication with another pressure tube 56 extending from the pressure tank 15 and positioned so as to be pinchably closed by spring biased trigger 13. A piston 58 is movably mounted within actuator manifold 52. Piston 58 has a top seal 59 and a bottom seal 60. The actuator 50 also has a pressure cylinder 62 having a vent 61 adjacent its top end. Pressure cylinder 62 is coupled in fluid communication with pressure chamber 35 by a pressure tube 63. A piston 64, having an elongated piston rod 65, is mounted within the actuator pressure cylinder 62 for reciprocal movement therein between a low pressure position shown in FIGS. 2 and 3 and a high pressure position shown in FIG. 4. A coil spring 67 mounted about piston rod 65 biases the piston 64 towards its low pressure position. Piston rod 65 is coupled to piston 58 by an over center torsion spring 68, such as that made by Barnes Group Incorporated of Corry, Pa. under model number T038180218-R. An indexing finger 69, mounted to an end of the piston rod 65, is configured to sequentially engage and ride within each magazine L-shaped groove 33.

In use, an operator actuates the pump to pressurize a supply of air by grasping the handle 22 and reciprocating the cylinder rod 21 back and forth within the cylinder 20. Pressurized air is passed through pressure tube 16 into the pressure tank 15. Manual actuation of the trigger 13 moves the trigger to a position wherein it unpinches pressure tube 56 so as to allow pressurized air within the pressure tank 15 to pass through pressure tube 56 into actuator manifold 52 between the top and bottom seals 59 and 60. The pressurized air then passes out of lower opening 55 and through pressure tube 51 into release valve manifold 45.

The pressurized air within the release valve manifold 45 causes the plunger 46 to move to a forward position sealing the opening 37. Pressurized air then flows between the plunger 46 and the release valve manifold 45 so as to pressurize the pressure chamber 35. A portion of the pressurized air within pressure chamber 35 passes through pressure tube 63 into the actuator pressure cylinder 62. With increased pressure within pressure cylinder 62 the piston 64 is forced upwards against the biasing force of coil spring 67, i.e. the piston 64 is moved from its low pressure position shown in FIG. 3 to its high pressure position shown in FIG. 4. As shown in FIG. 4, upward movement of the piston rod 65 causes compression of torsion spring 68 and the finger 69 to ride up within a mounting plate groove 33 thereby causing clockwise rotation of the magazine 18 which brings opening 28" into fluid communication with seal plate 38. All references herein to downward and upward directions is for purposes of clarity in reference to the drawings and is not meant to indicate gravity sensitivity. Upon reaching the apex of the movement of piston rod 65 the torsion spring 68 decompresses thereby forcing piston 58 downward, as shown in FIG. 5. Downward movement of piston 58 causes the top seal 59 to be positioned between upper opening 53 and lower opening 55. This positioning of the piston 58 isolates manifold lower opening 55 to prevent escape of pressurized air from pressure tank 15. This positioning of the top seal 59 also allows pressurized air within pressure tube 51 to escape to ambience through the top of actuator manifold 52. The release of air pressure causes the plunger 46 to move to a rearward position unsealing opening 37. With the unsealing of opening 37 pressurized air within pressure chamber 35 flows through opening 37, into the central and elongated bores 39 and 40 of sealing plate 38, and into the launch tube 27 through mounting plate opening 28. Pressurized air within launch tube 27 propels the projectile out of the magazine barrel 26 and through gun barrel 12. The actuation of this type of release valve is described in more detail in U.S. Pat. No. 4,159,705.

Upon the release of pressurized air from pressure chamber 35 the pressurized air within pressure cylinder 62 is released through pressure tube 63 back into pressure chamber 35. The release of air from pressure cylinder 62 causes the piston 64 be spring biased by coil spring 67 back downward to its low pressure position. The downward movement of piston 64 retracts the indexing finger 69 from within a mounting plate groove 33 and positions the finger in register with the following mounting plate groove 33. The low pressure positioning of piston 64 causes the torsion spring 68 to bias piston 58 upwards to its initial position with the top and bottom seals 59 and 60 straddling upper and lower openings 53 and 55, as shown in FIG. 3. This repositioning of piston 58 once again causes pressurized air within pressure tank 15 to flow through pressure tube 56 into actuator manifold 52, thereby completing a firing cycle. The firing and indexing cycle just describe may continue in rapid sequence so long as the trigger is maintained in a position allowing the flow of pressurized air through pressure tube 56 and the pressure tank continues to contains a minimal level of pressurized air sufficient to overcome the biasing force of springs 67 and 68, i.e. the release valve is automatically actuated by actuator 50 and the indexing of magazine 18 continues so long as the trigger is pulled open and the pressure tank contains pressurized air above a level to overcome springs 67 and 68. Should the pressure level within pressure tank 15 reach the minimal level the operator simply actuates the manual air pump 14 so as to once again elevate the pressure within the pressure tank.

As described, the gun may be used in a fully automatic manner such that with the trigger maintained in a pulled back, actuated position the gun fires a series of projectiles without stopping between each successive shot, similar to the action of a machine gun. However, should an operator wish to fire a single projectile, one need only to pull the trigger and quickly release it so that pressurized air does not continue to flow into the actuator 50. Operated in such a manner the gun will index the magazine and fire a projectile with each actuation of the trigger, again, so long as the pressure tank contains air pressurized above the minimal level and the trigger is quickly released.

It should be noted that pawl 32 engages teeth 31 to prevent rotation of the magazine in a direction opposite to its indexing direction, i.e. to prevent counterclockwise rotation in FIG. 3. This prevents the firing of pressurized air into a just emptied barrel and damage to the indexing finger. It should also be noted that since the pneumatic system is closed, once the gun is initially pressurized it is maintained under at least the minimal pressure level. Thus, the gun has the capability of firing projectiles in a rapid sequence of shots one after another. Yet, the gun may also fire a sequence of single shots without having to be pumped between each successive shot.

Referring next to FIGS. 6–9, a compressed air gun 70 in another preferred form is shown. Here, the air gun 70 has a housing 71 having a support plate 72 and an L-shaped support arm 73, a magazine 75 rotationally mounted to the housing 71, a remote manual hand air pump 76, and a harness 77 secured to housing 71 and configured to be supported upon the head of a person. The gun 70 has a pressure chamber 79 adapted to receive and store a supply of air at elevated pressure levels and a pressure actuatable release valve 80 mounted within the pressure chamber 79. A control valve 81 is mounted in fluid communication with release valve 80 and is coupled in fluid communication with pump 76 by a pressure tube 78 extending therebetween. Pressure chamber 79 is pneumatically coupled to a pneumatic indexer 82 which in turn is coupled to magazine 75 for rotational movement thereof.

The head harness 77 has a generally circular base strap 83 and a inverted U-shaped, adjustable top strap 84 secured to the base strap 83 by a buckle 85. The head harness 77 also has a clear eye sight 86 configured to be positioned over the eye of a person. The top strap 84 and base strap 83 may be made of a soft, flexible plastic which can conform to the person's head.

Figure 9:
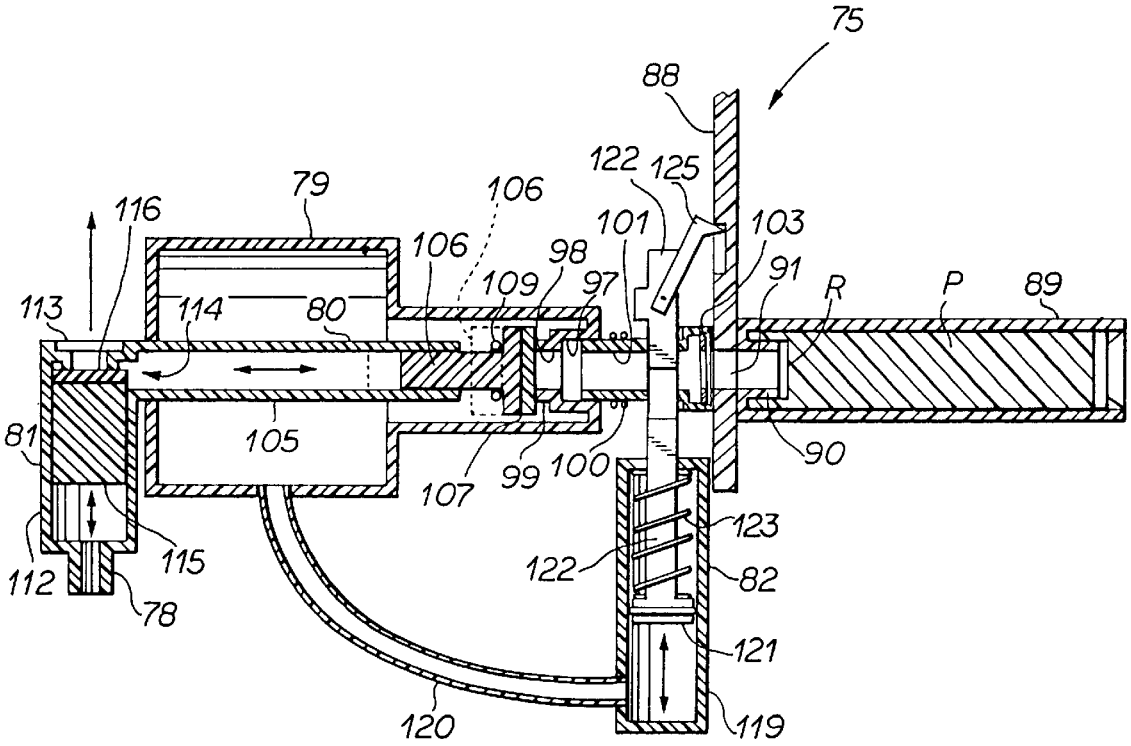
FIG. 9 is a side view, shown in partial cross-section, of interior components of the air gun of FIG. 6 and a projectile positioned within the barrel of the gun.

The magazine 75 has a central pivot rod 87 fixedly mounted to a disk-shaped mounting plate 88 and an annular array of projectile barrels or launch tubes 89 extending from the mounting plate 88 in a generally concentric circle about pivot rod 87. Pivot rod 87 is rotationally mounted at one end to support arm 73 and rotationally mounted at its opposite end to support plate 72. Each barrel 89 has a launch tube 90 therein aligned with an opening 91 which extends through the mounting plate 88. The interior diameter of barrel 89 is configured to releasably hold a projectile P with the launch tube 90 configured to be received within a recess R in the rear of the projectile. The magazine is shown in FIG. 9 as having only one barrel 89 for clarity of explanation. Mounting plate 88 has series of peripheral notches 93 each of which is aligned with a barrel 89. The notches 93 are configured to cooperate with a pawl 94 extending from the housing 71. Mounting plate 88 also has an annular array of L-shaped grooves 95 oriented about pivot rod 87 which are equal in number to the number of magazine barrels 89.

The pressure chamber 79 has a recess 97 having an air exit opening 98 therein defined by an inwardly extending annular flange 99. A spring biased sealing plate 100 is mounted within recess 97. The sealing plate 100 has a central bore 101 configured to overlay the mounting plate openings 91 of the magazine. It should be noted that the mounting plate openings 91 are positioned so that the sealing plate bore 101 overlaps only one opening 91 at a time. A gasket 103 is mounted to the sealing plate 100 to ensure sealing engagement with the mounting plate 88. The release valve 80 has a cylindrical manifold 105 and a cylindrical plunger 106 slidably mounted within the manifold 105. Plunger 106 has a gasket 107 to ensure sealing engagement of the plunger 106 about opening 98 with the plunger in a sealing position shown in FIG. 9, and a O-ring type seal 109 to ensure sealing engagement of the plunger 106 against manifold flange 99 with the plunger in a released position shown in phantom lines in FIG. 9.

The control valve 81 has an elongated cylindrical manifold 112 having a top vent opening 113 to ambience, a side opening 114 in fluid communication with release valve manifold 105, and a cylindrical plunger 115 slidably mounted within manifold 112. Plunger 115 has a gasket 116 to ensure sealing engagement of the plunger about vent opening 113 with the plunger in a pressurized position shown in FIGS. 7 and 9.

The indexer 82 has a pressure cylinder 119 coupled in fluid communication with pressure chamber 79 by a pressure tube 120. A piston 121, having an elongated piston rod 122, is mounted within the indexer pressure cylinder 119 for reciprocal movement therein between a low pressure position shown in FIG. 8 and a high pressure position shown in FIGS. 7 and 9. A coil spring 123 is mounted about piston rod 122 so as to bias the piston 121 towards its low pressure position. A spring biased indexing finger 125 is pivotably mounted to piston rod 125. Indexing finger 125 is configured to sequentially engage and ride within each magazine groove 95 as the piston rod is moved upward and to disengage the groove as the piston rod is moved downward. All references herein to downward and upward directions is for purposes of clarity in reference to the drawings and is not meant to indicate gravity sensitivity.

The air pump 76 includes an elongated cylinder 128 and a plunger 129 telescopically mounted for reciprocal movement within the cylinder 128. Plunger 129 has a tubular shaft 130 with an enlarged sealing end 131 and a handle 132 opposite the sealing end 131. Sealing end 131 has an O-ring type seal 133 with an opening 134 therethrough, and a conventional check valve 135 mounted within opening 134. Check valve 135 is oriented to allow air to pass from the interior of cylinder 128 through opening 134 into the interior of shaft 130 and to prevent air from passing through opening 134 in the opposite direction. Handle 132 has a vent 136 therethrough which allows air to pass from ambience into the interior of shaft 130.

Pump cylinder 128 has an open end 138 through which plunger 129 extends and a closed end 139. The pump cylinder 128 also has a port 140 in fluid communication with pressure tube 78 and a vent 141 adjacent open end 138 which is open to ambience. Port 140 is spaced from closed end 139 so as to allow seal 133 of plunger 129 to be moved past the port 140 to a position closely adjacent to the closed end 139, as shown in FIG. 8.

In use, a person dons the gun by securing the head harness 77 to his head with the magazine 75 to one side. The person then actuates the pump 76 by grasping the pump handle 132 and forcing the pump plunger 129 through cylinder 128 towards port 140 thereby pressurizing air within the cylinder. Thus, the plunger 129 is moved from a first position shown in phantom lines in FIG. 7 to generally a second position shown in FIG. 7. The pressurized air passes through port 140 into pressure tube 78 where it then passes through control valve 81. The increase in air pressure within the control valve manifold 112 forces the control valve plunger 115 to move to an upper, pressurized position sealing vent opening 113, as shown in FIG. 9. The pressurized air then passes about plunger 115 and through side opening 114 into the release valve manifold 105. The increase in air pressure within the release valve manifold 105 forces the control valve plunger 106 to move to a forward, pressurized position sealing opening 98, as shown in FIG. 9. The pressurized air then flows between the release valve plunger 106 and the release valve manifold 105 into pressure chamber 79.

A portion of the pressurized air within pressure chamber 79 passes through pressure tube 120 into the indexer pressure cylinder 119. With increased pressure within pressure cylinder 119 the indexer piston 121 is forced upwards against the biasing force of coil spring 123, i.e. the indexer piston 121 is moved from its low pressure position shown in FIG. 8 to its high pressure position shown in FIGS. 7 and 9. As shown in FIG. 9, upward movement of the piston rod 122 causes the finger 125 to ride up within a mounting plate groove 95 to cause counter-clockwise rotation of the magazine 75 as indicated by arrows in FIGS. 7 and 8.

Figure 8:
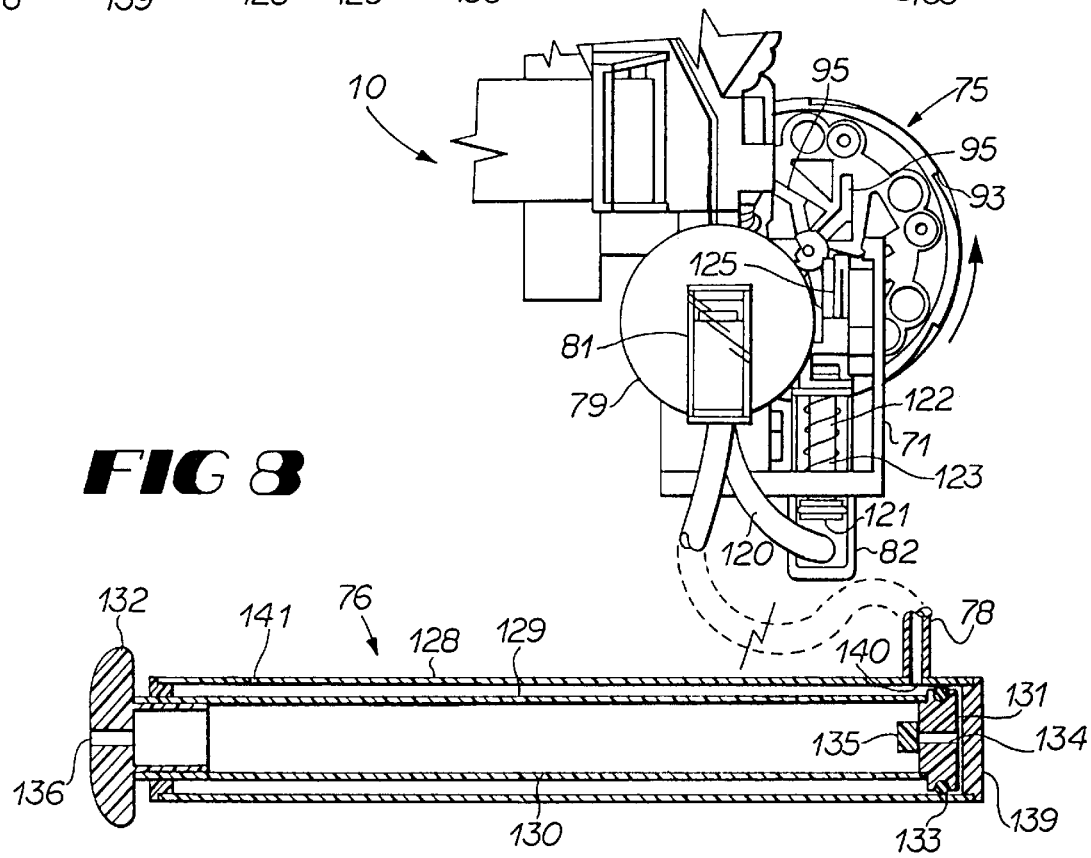
FIG. 8 is a rear view of portions of the air gun of FIG. 6 with the pump shown in side view for clarity of explanation.

With continued movement of the pump plunger 129 within pump cylinder 128 the seal 133 passes pump cylinder port 140, as shown in FIG. 8. With the plunger seal 133 in this position pressurized air within pressure tube 78 is released back into pump cylinder 128 behind seal 133 and then to ambience through vent 141. The reentry of pressurized air into the pump cylinder 128 from pressure tube 78 causes the control valve plunger 115 to move to a downward position unsealing vent opening 113, as shown in FIG. 8. Thus, the decrease in air pressure within the pressure tube 78 and control valve manifold 112 triggers the actuation of control valve 81 to its open configuration. The actuation of the control valve to its open, downward position causes a release of pressurized air from within release valve manifold 105 through the control valve side opening 113 and then through vent opening 113 to ambience. This decrease in pressure causes release valve plunger 106 to move to a rearward position unsealing opening 98, as shown in phantom lines in FIG. 9. The position of the plunger 106 also causes and the O-ring to abut manifold 105 to seal the path between the manifold 105 and plunger 106. With the unsealing of opening 98 pressurized air within pressure chamber 79 rapidly flows through opening 98, through sealing plate bore 101, through magazine mounting plate opening 91, and into launch tube 90 in register with the sealing plate 100 where it propels the projectile P from barrel 89. Operation of this type of release valve is described in more detail in U.S. Pat. No. 4,159,705.

Upon the release of pressurized air from pressure chamber 79 the pressurized air within indexer pressure cylinder 119 is conveyed through pressure tube 120 back into pressure chamber 79. This release of pressurized air from indexer pressure cylinder 119 causes the indexer piston 121 to be spring biased by coil spring 123 back downward to its low pressure position. The downward movement of piston 121 pivotally retracts the indexing finger 125 from mounting plate groove 95 and positions the finger in register with the following mounting plate groove.

The pump plunger 129 may then be manually drawn back to its initial position to pressurize and fire the gun again. The drawing back of the pump plunger 129 does not create a vacuum within pump cylinder 128 since replenishment air may be drawn through vent 136 into the plunger handle 132, through the interior of shaft 130, and through check valve 135 into cylinder 128. Air between the pump cylinder 128 and the plunger 129 behind seal 134 is expelled from cylinder 128 through vent 141.

Figure 7:
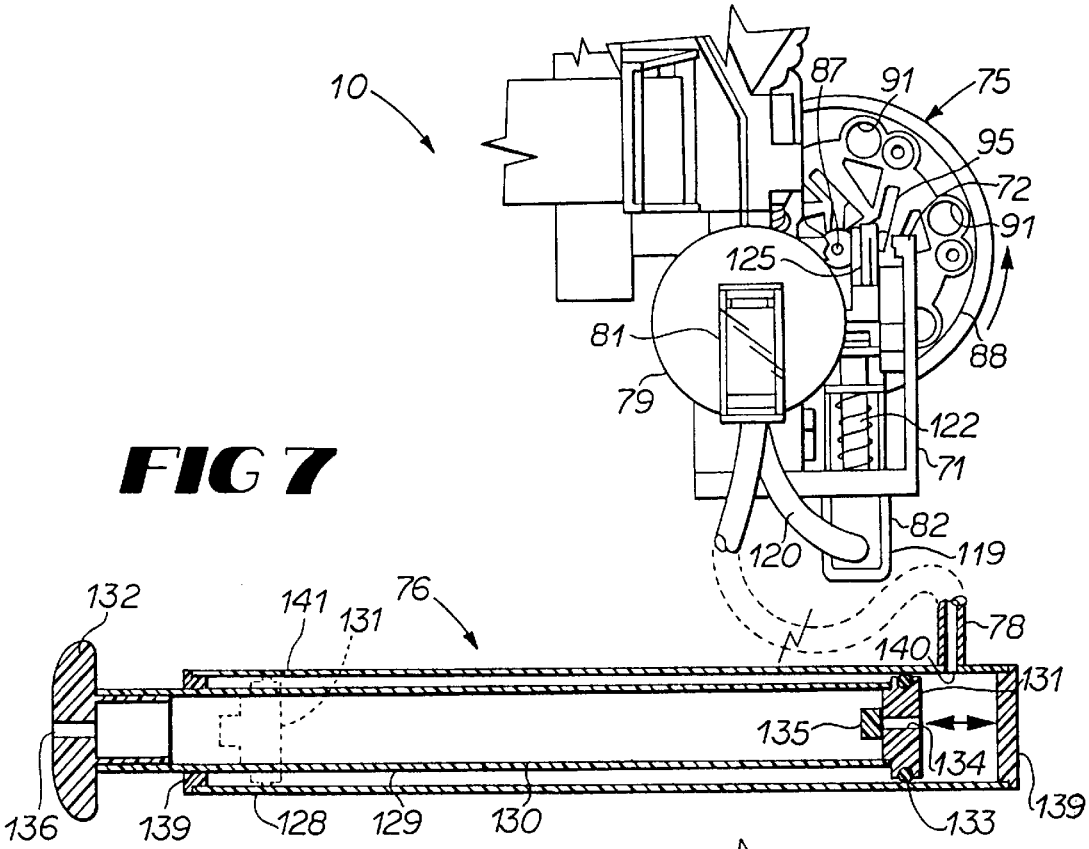
FIG. 7 is a rear view of portions of the air gun of FIG. 6 with the pump shown in side view for clarity of explanation.

It should be noted that pawl 94 engages notches 93 to prevent rotation of the magazine 75 in a direction opposite to its indexing direction, i.e. to prevent clockwise rotation of the magazine with reference to FIGS. 7 and 8. This prevents the firing of pressurized air into a previously emptied barrel and damage to the indexing finger 125.

As an alternative, gun 70 may also be constructed without control valve 81. The need for the control valve is dependent upon the length and interior diameter of pressure tube 78, i.e. the volume of air contained within the pressure tube. For a pressure tube 78 having a small interior volume the release of air therefrom causes rapid actuation of release valve 80. Conversely, with a pressure tube 78 containing a large volume of air therein the release of air therefrom may be inadequate to actuate the release valve properly. Thus, with pressure tubes having a large volume therein a control valve 81 is coupled to the release valve 80 to ensure rapid decompression within release valve manifold 105 to actuate the release valve. The gun may also be constructed without the inner launch tube 90 within the barrel 89. Here, the pressurized air expelled from pressure chamber 79 is directed into barrel 89 behind the projectile. This design however is not preferred as it does not concentrate the burst of pressurized air for optimal efficiency and performance. Lastly, it should be understood that the magazine and indexer of FIGS. 6–9 may also be adapted to a hand held gun of conventional design.

It should be understood that the gun of FIGS. 6–9 may also be adapted to include the two concentric circle arrangement of the opening, as shown in FIGS. 1–5, to increase the dart capacity of the magazine.

With the air gun of this construction a child may aim the gun simply by facing the intended target and manually actuating the hand pump. Because of the elongated, flexible pressure tube 78 the pump may be manipulated substantially independently of and without effecting the air of the launch tube. Thus, the gun is of an unconventional design to interest children yet is capable of being easily aimed and fired. Also, the child may fire several shots sequentially without having to reload between each successive shot.

Figure 10:
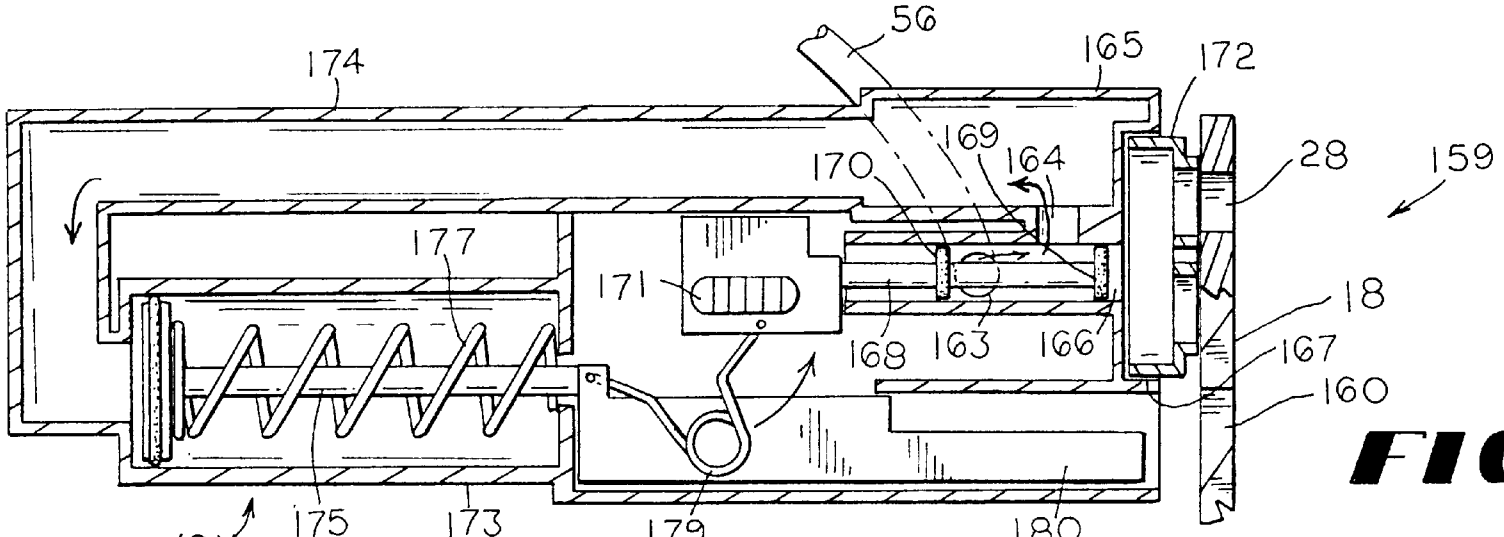
FIG. 10 is a side view, shown in partial cross-section, of an alternative design for the interior components of the air gun of FIG. 1, shown in a pressurizing configuration.
Figure 11:
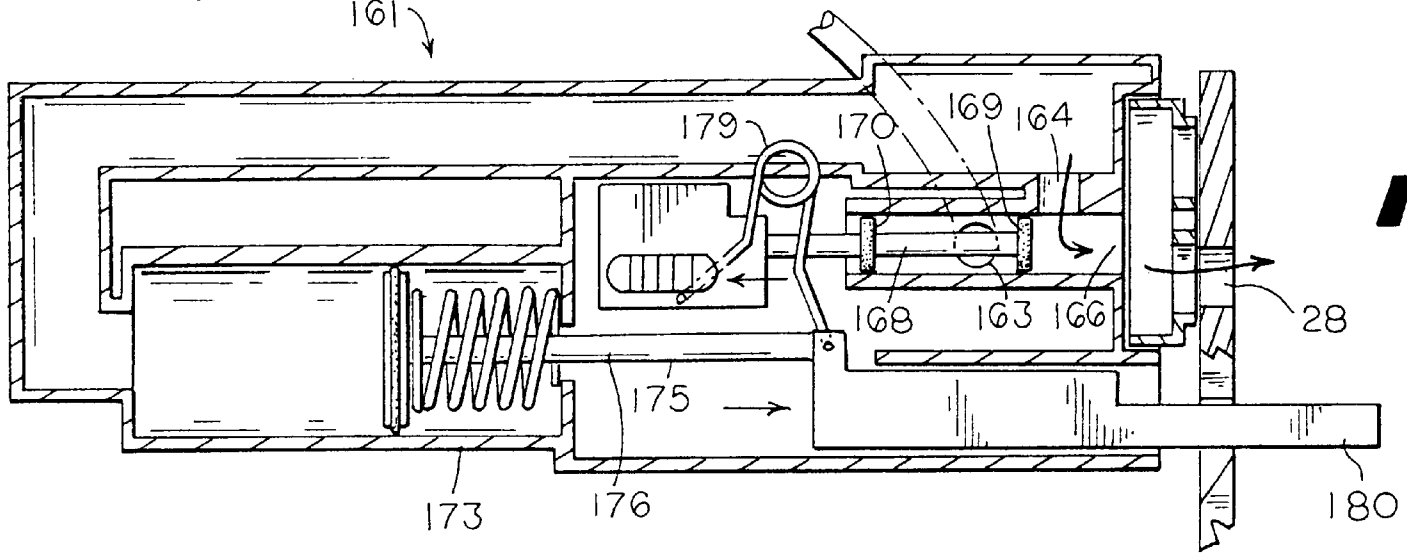
FIG. 11 is a side view, shown in partial cross-section, of the interior components shown in FIG. 10, shown in a firing configuration.
Figure 12:
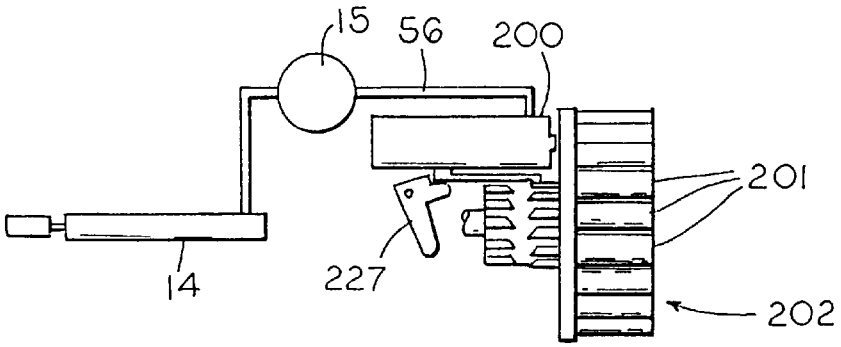
FIG. 12 is a schematic view of portions of an air compressed gun in another preferred form.

With reference next to FIGS. 10 and 11, a compressed air gun 159 in another preferred form is shown. Here, the air gun 159 is similar in basic construction to that shown in FIGS. 1–5, except for the internal components for the sequential firing of pressurized air bursts and pneumatic indexing of the magazine, and the magazine grooves 160 are angled rather than being L-shaped. For this reason, only the new, alternative components of the air gun are shown for clarity and conciseness of explanation.

The air gun 159 has a pneumatic firing actuator 161 coupled to the pressure tank through pressure tube 56. Actuator 161 includes an elongated manifold 162 having an inlet opening 163 in fluid communication with pressure tube 56, an outlet opening 164 in fluid communication with a small pressure tank or pressure cell 165, and an open end or firing opening 166 in fluid communication with an elongated recess 167. A piston 168 is mounted for reciprocal movement within actuator manifold 162. Piston 168 has a forward seal 169, a rearward seal 170 and a clear button 171 extending through the air gun housing. The actuator 161 also has a flexible gasket 172 mounted within recess 167 in sealable contact with magazine 18, and a pressure cylinder 173 in fluid communication with pressure cell 165 by a conduit 174. A piston 175, having an elongated piston rod 176, is mounted within the actuator pressure cylinder 173 for reciprocal movement therein between a low pressure, pressurizing position shown in FIG. 10 and a high pressure, firing position shown in FIG. 11. A coil spring 177 mounted about piston rod 176 biases the piston 175 towards its low pressure position. Piston rod 176 is coupled to piston 168 by an over center torsion spring 179. An indexing finger 180, mounted to an end of the piston rod 176, is configured to sequentially engage and ride within each magazine groove 160 for sequential rotation of the magazine.

In use, an operator actuates the pump to pressurize a supply of air by grasping the handle 22 and reciprocating the cylinder rod 21 back and forth within the cylinder 20. With piston 168 in its rearward pressurized air is passed through pressure tube 16 into the pressure tank 15. Manual actuation of the trigger 13 moves the trigger to a position wherein it unpinches pressure tube 56 so as to allow pressurized air within the pressure tank 15 to pass through pressure tube 56 into actuator manifold 162 through inlet opening 163 and between the forward and rearward seals 169 and 170 of piston 168. The pressurized air then passes out of manifold 162 through outlet opening 164 and into pressure cell 165, conduit 174, and pressure cylinder 173. The pressurized air within the pressure cylinder 173 causes piston 175 to move toward its high pressure position against the biasing force of coil spring 177, i.e. the piston 175 is moved from its low pressure position shown in FIG. 10 to its high pressure position shown in FIG. 11.

As shown in FIG. 11, forward movement of the piston 175 causes compression and rotation of torsion spring 179 and the indexing finger 180 to move forward into a magazine groove 160, thereby causing rotation of the magazine 18 and alignment of the opening to change to the inner circle of openings 28". All references herein to forward and rearward is for purposes of clarity in reference to the drawings. Upon reaching the apex of the movement of piston rod 176 the torsion spring 179 reaches a rotated position which causes decompression of the spring thereby forcing piston 168 rearward, as shown in FIG. 11. Rearward movement of piston 168 causes the forward seal 169 to be moved to a positioned between inlet opening 163 and the outlet opening 164. This positioning of the piston 168 isolates manifold inlet opening 163 to prevent escape of pressurized air from pressure tank 15, i.e. the seals sandwich the inlet opening to prevent the flow of air from the pressure tank. This positioning of the forward seal 169 also allows pressurized air within the pressure cell 165, conduit 174 and pressure cylinder 173 to flow through outlet opening 164 into the manifold and from the manifold through firing opening 166, through sealed recess 167 and into the launch tube 27 through magazine opening 28'. Pressurized air within launch tube 27 propels the projectile out of the magazine barrel 26 and through gun barrel 12.

The release of pressurized air from pressure cylinder 173 causes the piston 175 to be spring biased by coil spring 177 back rearward to its low pressure position. The rearward movement of piston 175 retracts the indexing finger 180 from within a mounting plate groove 160 and positions the finger in register with the following mounting plate groove 160. The low pressure positioning of piston 175 causes the torsion spring 179 to bias piston 168 forwards to its initial position with the forward and rearward seals 169 and 170 sandwiching or straddling inlet and outlet openings 163 and 164, as shown in FIG. 10. This repositioning of piston 168 once again causes pressurized air within pressure tank 15 to flow through pressure tube 56 into actuator manifold 162, thereby completing a firing cycle. The firing and indexing cycle just describe may continue in rapid sequence so long as the trigger is maintained in a position allowing the flow of pressurized air through pressure tube 56 and the pressure tank continues to contains a minimal level of pressurized air sufficient to overcome the biasing force of springs 177 and 179, i.e. the release valve is automatically actuated by actuator 161 and the indexing of magazine 18 continues so long as the trigger is pulled open and the pressure tank contains pressurized air above a level to overcome springs 177 and 179. Should the pressure level within pressure tank 15 reach the minimal level the operator simply actuates the manual air pump 14 so as to once again elevate the pressure within the pressure tank.

As described, the gun may be used in a fully automatic manner such that with the trigger maintained in a pulled back, actuated position the gun fires a series of projectiles without stopping between each successive shot, similar to the action of a machine gun. However, should an operator wish to fire a single projectile, one need only to pull the trigger and quickly release it so that pressurized air does not continue to flow into the actuator 161. Operated in such a manner the gun will index the magazine and fire a projectile with each actuation of the trigger, again, so long as the pressure tank contains air pressurized above the minimal level and the trigger is quickly released.

It should be understood that at times rubber seals often stick when stored for a period of time. This sticking may hamper the performance of the actuator. For this reason, the actuator is provided with clear button 171 which may be manually actuated to cause reciprocal movement of the piston in order to unstick the seals.

With reference next to FIGS. 12–15, there is shown a compressed air gun in another preferred embodiment, with like numbers referring to previously described components. Here, the air gun has a combination control valve and indexer 200 which controls the flow of compressed air from the pressure tank 15 to the magazine launch tubes 201 and indexes the magazine 202 with each firing, hereinafter referred collectively as control valve 200.

The control valve 200 has an elongated, cylindrical, external tube or manifold 204, a cylindrical, internal tube 205 mounted within the external tube 204, and a plunger 206 mounted within the internal tube. The external tube 204 has an elongated slot 208, an air inlet 209 in fluid communication with pressure tube 56, and an air outlet 210 in fluid communication with magazine launch tubes 201. The internal tube 205 is configured to move reciprocally within the external tube between a forward position shown in FIG. 13 and a rearward position shown in FIGS. 14–16. The internal tube 205 and external tube 204 define a first air pressure chamber 212 therebetween, while the internal tube 205 and plunger 206 define a second air pressure chamber 213 therebetween. The internal tube 205 has an air release valve 215, an O-ring seal 216 for sealing engagement of the internal tube with the external tube, and an L-shaped member 218 extending through slot 208. L-shaped member 218 has an end flange 219.

Plunger 206 is mounted within the internal tube 205 for reciprocal movement between a first sealing position abutably sealing air outlet 210 as shown in FIG. 13, a second sealing position extending from the internal tube yet still sealing air outlet 210 as shown in FIGS. 14 and 15, and an unsealing position distal from and unsealing air outlet 210 as shown in FIG. 16. The air release valve 215 has an opening 221, a plunger 222 mounted within opening 221, an elongated rod 223, and a coil spring 224 mounted about elongated rod 223. The air gun also has a spring biased trigger 227 configured to releasably engage the internal tube L-shaped member 218.

A coil spring 229 is mounted within internal tube 205 so as to abut plunger 206 and bias the plunger in a direction towards the air outlet 210. Another coil spring 230 is mounted between the external tube 204 and the internal tube 205 so as to bias the internal tube in a direction towards the air outlet 210.

The magazine 202 has an annular array of Z-shaped grooves 232 sized and shaped to receive the end flange 219 of the L-shaped member 218. Each groove 232 has a forward camming surface 233 extending to a forward portion 234 and a rearward camming surface 235 extending to a rearward portion 236.

Figure 21:
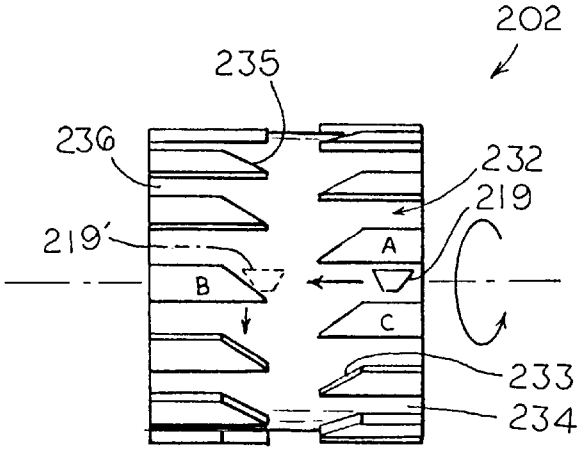
FIGS. 21 and 22 are a sequence of top views of the magazine of the air gun of FIG. 12, which show in sequence, the rotation of the magazine in conjunction with the actuation of the control valve.
Figure 22:
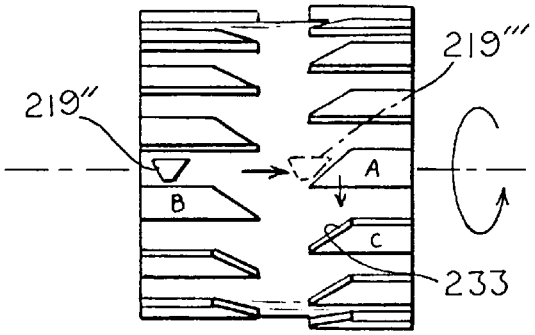

In use and with the trigger 227 spring biased to its position engaging the internal tube L-shaped member 218, the internal tube 205 is initial spring biased to its forward position by compressing spring 230, as shown in FIG. 13. This position of the internal tube forces spring 229 to bias plunger 206 to its sealing position. With the internal tube 205 in its forward position, the L-shaped member flange 219 resides within the Z-shaped groove forward portion 234, as shown in FIG. 21. It should be understood that the magazine of FIGS. 21 and 22 is illustrated with only one launch tube for clarity of explanation.

As compressed air flows from the pressure tube 56, extending from the pressure tank 15, and into the control valve 200 through air inlet 209, the pressure within the first air pressure chamber 212 increases. Compressed air also passes from the first air pressure chamber, between the plunger 206 and the internal tube, into the second air pressure chamber 213. The air pressure within the first and second air pressure chambers aid in maintaining the plunger 206 in its sealing position, as the pressure upon the backside of the plunger is greater than ambient air pressure upon the front side of the plunger.

As shown in FIG. 14, with movement of the trigger 227 to its release position disengaged from the L-shaped member, the compressed air within the first air pressure chamber 212 causes the internal tube 205 to move to its rearward position. This movement of the internal tube compresses spring 230. As the internal tube moves rearward the L-shaped member flange 219' contacts the rearward camming surface 235, as shown in phantom lines in FIG. 22. With continued rearward movement of the internal tube, flange 219" continues into the rearward portion 236 of the Z-shaped groove, as shown in FIG. 22. The force of the flange upon the rearward camming surface causes the magazine to rotate clockwise approximately half the distance of a complete indexing cycle.

As the internal tube approaches the end of its rearward stroke the release valve spring 224 compresses to a point wherein the force of the spring overcomes the force of the air pressure within the second air pressure chamber 213. This spring force causes the valve plunger 206 to move forward thereby unseating and allowing the compressed air within the second air pressure chamber 213 to escape rapidly therefrom through opening 221, as shown in FIG. 15. This rapid decompression of the second air pressure chamber 213 causes plunger 206 to snap back to its unsealing position, as shown in FIG. 16. With the plunger in its unsealing position, the compressed air within the first pressure chamber 212 quickly passes through the air outlet 210 and into the launch tube 201.

The release of the compressed air within the first air pressure chamber 212 causes the internal tube to move forward, through the spring biasing force of coil spring 230. The forward movement of the internal tube causes the L-shaped member flange 219'" to contact the forward camming surface 233, as shown in phantom lines in FIG. 22, and thus force the remaining indexing rotation of the magazine as the flange 219 once again resides within the forward portion 234, as shown initially in FIG. 21.

It should be understood that so long as the trigger is actuated to its disengaged position and so long as there is sufficient air pressure flowing from the pressure tube, the control valve will continue to fire projectiles, as the internal tube and plunger will continue to reciprocate as long as a sufficient amount of compressed air is present to overcome the forces of the springs. Alternatively, the trigger may be pulled and immediately released so that it reengages the L-shaped member after firing a single projectile.

With reference next to FIGS. 17–20, there is shown the internal components and a portion of the magazine of a compressed air gun in another preferred embodiment, similar to that previously described in reference to FIGS. 12–16. Here again, the air gun has a combination control valve and indexer 300 which controls the flow of air from the pressure tank 15 to the magazine launch tubes 201 and indexes the magazine 202 with each firing, hereinafter referred collectively as control valve. The control valve 300 has an elongated, cylindrical, external tube or manifold 304, an internal tube 305 mounted within the external tube 304, and a plunger 306 mounted within the internal tube. The external tube 304 has an elongated slot 308, an air inlet 309 in fluid communication with pressure tube 56, and an air outlet 310 in fluid communication with magazine launch tubes 201. The internal tube 305 is configured to move reciprocally within the external tube between a forward position, shown in FIG. 17 and a rearward position, shown in FIGS. 18–20. The internal tube 305 and external tube 304 define an air pressure chamber 312 therebetween. The internal tube 305 has an O-ring seal 316 for sealing engagement of the internal tube with the external tube, and an L-shaped member 318 extending through slot 308. L-shaped member 318 has an end flange 219. A coil spring 329 is mounted about the plunger 306 for biased movement of the plunger in a rearward direction.

Plunger 306 is mounted within the internal tube for reciprocal movement between a first sealing position abutably sealing air outlet 310 as shown in FIG. 17, a second sealing position extending from the internal tube yet still sealing air outlet as shown in FIGS. 18 and 19, and an unsealing position distal from and unsealing air outlet as shown in FIG. 20. The air gun also has a spring biased trigger 327 configured to releasably engage the internal tube L-shaped member 318.

A coil spring 330 is mounted about plunger 306 between the forward end of the internal tube and a sealing head 331 of the plunger. Coil spring 330 biases the plunger in a direction towards the air outlet. Another coil spring 328 is mounted between the external tube 304 and the internal tube so as to bias the internal tube in a direction towards the air outlet.

The magazine 202 has an annular array of Z-shaped grooves 232 sized and shaped to receive the end flange 219 of the L-shaped member 318. Each groove 232 has a forward camming surface 233 extending to a forward portion 234 and a rearward camming surface 235 extending to a rearward portion 236.

In use and with the trigger 327 is spring biased to its position engaging the internal tube L-shaped member, the internal tube 305 is initial spring biased to its forward position compressing spring 330. This position of the internal tube forces spring 330 to bias plunger 306 to its sealing position. With the internal tube 305 in its forward position, the L-shaped member flange 219 resides within the Z-shaped groove forward portion 234, as shown in FIG. 21.

As compressed air flows from pressure tube 56 and into the control valve 300 through air inlet 309, the pressure within air pressure chamber 312 increases. This air pressure aids in maintaining the plunger in its sealing position, as the pressure upon the backside of the plunger is greater than ambient air pressure upon the front side of the plunger.

As shown in FIG. 18, with movement of the trigger to its release position disengaging the L-shaped member, the compressed air within the air pressure chamber 312 causes the internal tube 305 to move to its rearward position. This movement of the internal tube compresses springs 328 and 329. As the internal tube moves rearward the L-shaped member flange 219' contacts the rearward camming surface 235 so as to cause the magazine to rotate clockwise approximately half the distance of a complete indexing cycle, as shown in phantom lines in FIG. 22. The flange 219" continues into the rearward portion 236 of the Z-shaped groove.

As the internal tube moves to the end of its rearward stroke the plunger spring 329 compresses to a point wherein the force of spring 329 overcomes the force of the compressed air within the air pressure chamber 312 and upon the plunger sealing head 331. This spring force causes the plunger 306 to move rearwardly to its unsealing position, thereby allowing the compressed air within the air pressure chamber to escape through the air outlet 310, as shown in FIG. 19. The release of the air pressure force upon the plunger allows spring 329 to force plunger 306 quickly rearward to maximize the rapid decompression of the air pressure chamber 312, as shown in FIG. 19.

The release of the compressed air within the air pressure chamber 312 causes the internal tube to move forward, through the spring biasing force of coil spring 328. The forward movement of the internal tube causes the L-shaped member flange 219'" to contact the forward camming surface 233, as shown in phantom lines in FIG. 22, and thus force the remaining indexing rotation of the magazine as the flange once again resides within the forward portion 234, as shown initially in FIG. 21. Again, the internal tube and plunger may continue to reciprocate as long as the trigger is disengaged and there is sufficient air pressure.

It should be understood that the second air pressure chamber 213 of FIGS. 13–16 performs the same function as spring 329 in FIGS. 17–20, as they both function to snap the plunger rearward upon initial firing.

The gun shown in FIGS. 17–20 may also be adapted to include an internal flange 340, shown in phantom lines, extending from the external tube 305. Flange 340 has a opening 341 therethrough through which plunger 306 extends. Spring 330 abuts flange 340 so that the spring is slightly compressed to force plunger 306 towards its sealing position. As the internal tube 305 moves rearward the spring 330 is compressed further. As air is released from the first air chamber 312, as previously described, spring 330 decompresses so as to force plunger 306 to is sealing position.

It should also be understood that compressed air may be directed into the control valve without the use of a pressure tank 15, as shown in reference to FIGS. 6–9. As such, the control valve may be coupled directly to a pump. Also, the triggering of the control valve, and thus the toy gun, may be accomplished through a valve or regulator mounted between the pressurized air source and the control valve, as shown in the previous embodiments.

With reference next to FIGS. 23–26, there is shown the internal components of a fluid pulsator 400 in another preferred embodiment, similar to the control valve previously described in reference to FIGS. 12–16 and 17–20. The fluid pulsator may be used to control the release of compressed air, as previously described, in compressed air guns or to control the release of pressurized water in discrete bursts in water guns. When used in conjunction with an air gun the pulsator acts as a combination control valve and indexer which controls the flow of air from the pressure tank 15 to the magazine launch tubes 201 and which indexes the magazine 202 with each firing.

The pulsator 400 has an elongated, cylindrical, housing or manifold 404, an internal tube or plunger 405 mounted within the housing 404, and a sealing member 406 mounted about the internal tube. The housing 404 has a rear opening 408 through which extends the internal tube, a fluid inlet 409 in fluid communication with pressure tube 56, and a fluid outlet 410, in fluid communication with magazine launch tubes 201 of an air gun or ambience with a water gun. The internal tube 405 has a fluid inlet 420, a fluid outlet 421 and a post 422 about which is mounted the sealing member 406. The internal tube 405 is configured to move reciprocally within the housing between a forward position, shown in FIG. 23, and a rearward position, shown in FIGS. 24–26. The internal tube 405 and housing 404 define a rearward fluid pressure chamber 412 and a forward fluid pressure chamber 413 therebetween. The internal tube 405 has a sealing edge 416 for sealing engagement of the internal tube with the housing, and an L-shaped linkage member 418. In an air gun the L-shaped member 418 has a previously described end flange 219, while in a water gun the L-shaped member 418 extends to a sleeve 419 coupled to the end of the barrel for reciprocal movement relative to the barrel. The sealing member 406 has an opening 424 therethrough and a resilient sealing head 431 having a first portion 432 having a size and shape larger than fluid outlet 410 and a second portion 433 sized and shaped to be received within the fluid outlet 410. A coil spring 429 is mounted within the sealing member 406 and about the post 422 for biased movement of the sealing member in a rearward direction as the spring is compressed, as shown in FIG. 26.

Figure 25:
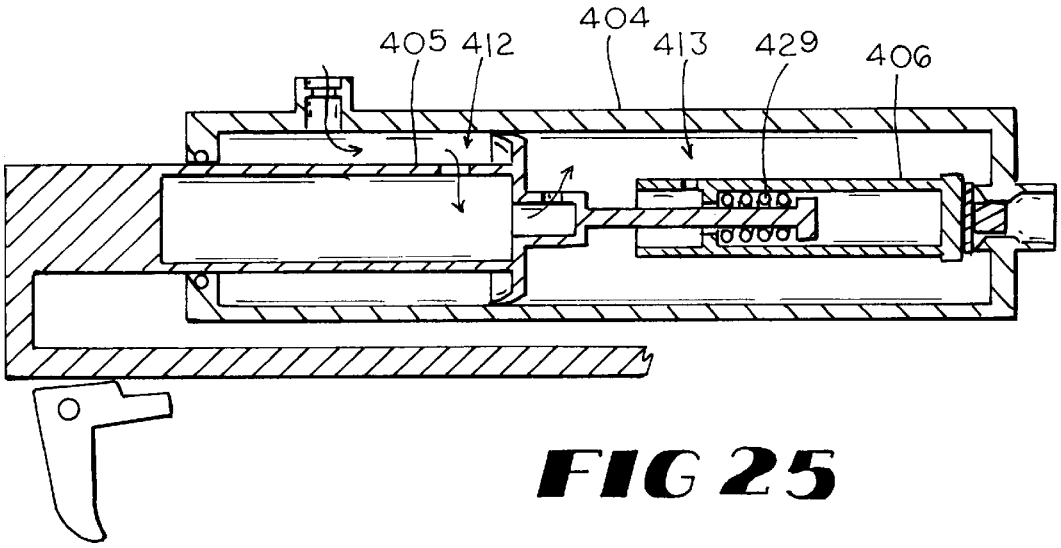
Figure 26:
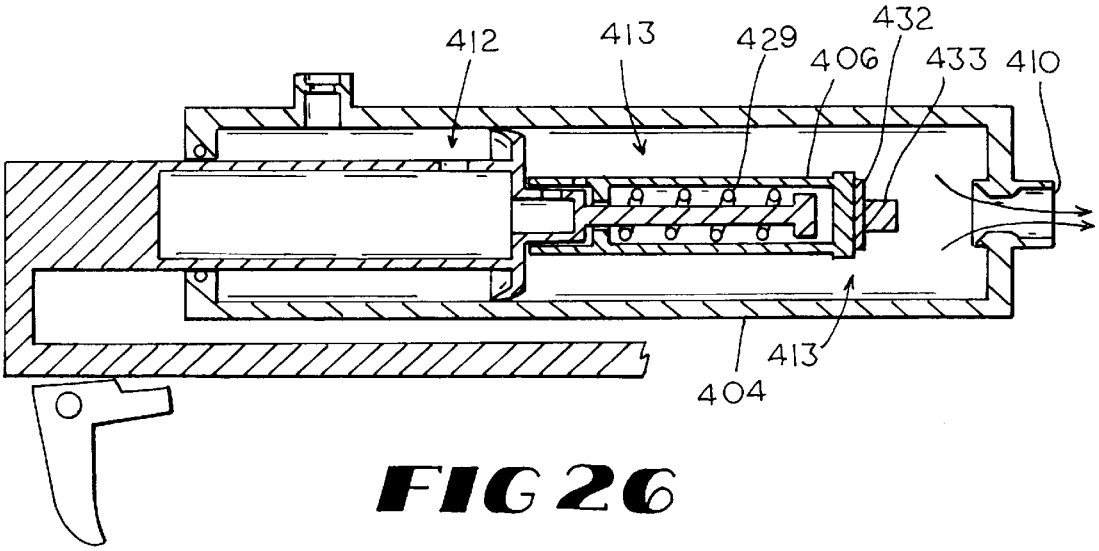

Sealing member 406 is mounted about the internal tube post 422 for reciprocal movement between a first sealing position sealing fluid outlet 410 as shown in FIG. 23, a second sealing position extending from the internal tube yet still sealing fluid outlet as shown in FIGS. 24 and 25, and an unsealing position distal from and unsealing fluid outlet as shown in FIG. 26. The air or water gun also has a spring biased trigger 427 configured to engage and disengage the internal tube L-shaped member 418.

In an air gun configuration, the previously described magazine 202 has an annular array of Z-shaped grooves 232 sized and shaped to receive the end flange 219 of the L-shaped member 418. Each groove 232 has a forward camming surface 233 extending to a forward portion 234 and a rearward camming surface 235 extending to a rearward portion 236.

In use and with the trigger 427 spring biased to its position engaging the internal tube L-shaped member, the internal tube 405 is maintained in its forward position while fluid enters the pulsator. With the internal tube 405 in its forward position, the L-shaped member flange 219 resides within the Z-shaped groove forward portion 234, as shown in FIG. 21.

As pressurized fluid flows from pressure tube 56 and into the pulsator 400 through fluid inlet 409, the pressure within the rearward fluid pressure chamber 412 increases. The pressurized fluid passes through internal tube fluid inlet 420, through internal tube fluid outlet 421 between the internal tube 405 and sealing member 406, through sealing member opening 424 and slowly into the forward fluid pressure chamber 413, i.e. the fluid slowly passes from inside the internal tube and between the internal tube and sealing member to the forward fluid pressure chamber 413, See FIG. 23. As shown in FIG. 24, with movement of the trigger 427 to its release position disengaging the L-shaped member, the pressurized fluid within the forward fluid pressure chamber 413 and within the internal tube 405 overcomes the fluid pressure within the rearward fluid pressure chamber which causes the internal tube to move towards its rearward position. As the internal tube moves rearward its fluid outlet 421 is positioned past the end of the sealing member, thus causing the unrestricted flow of fluid therethrough and into the forward fluid pressure chamber 413, rather than the slow flow previously associated with the fluid outlet 421. As shown previously in FIG. 22, this movement also causes the L-shaped member flange 219' of an air gun to contact the rearward camming surface 235 so as to cause the magazine to rotate clockwise approximately half the distance of a complete indexing cycle, as shown in phantom lines in FIG. 22. The flange 219" continues into the rearward portion 236 of the Z-shaped groove.

As the internal tube moves to the end of its rearward stroke the spring 429 compresses to a point wherein the force of spring overcomes the force of the pressurized fluid within the forward fluid pressure chamber 413 and upon the sealing member head 431. This spring force causes the sealing member 406 to move rearwardly to its unsealing position, thereby allowing the pressurized fluid within the forward pressure chamber 413 to escape through the fluid outlet 410, as shown in FIG. 26. The release of the fluid pressure force upon the sealing member allows spring 429 to force sealing member 406 quickly rearward to maximize the rapid decompression of the rearward fluid pressure chamber 412. The release of the pressurized fluid within the forward pressure chamber 413 causes the internal tube to move forward, through the biasing force of the fluid entering the rearward pressure chamber 412.

Figure 29:
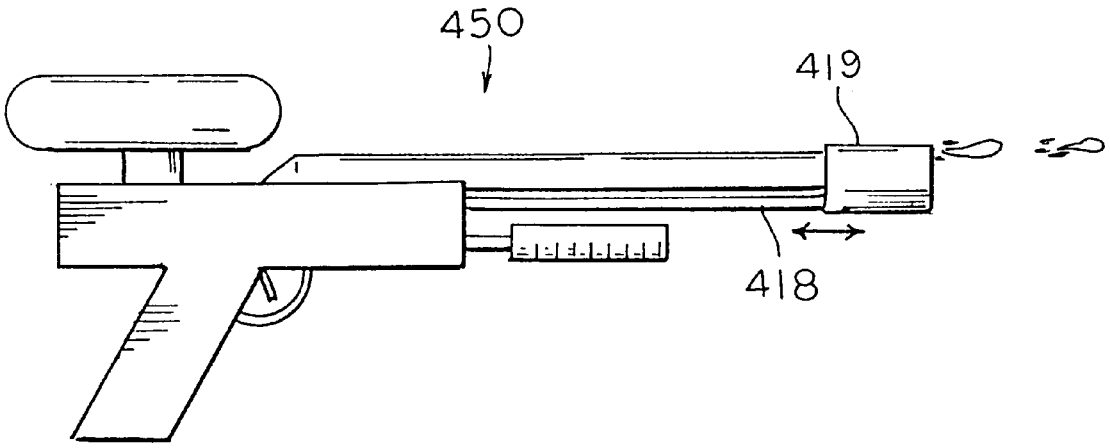
FIG. 29 is a schematic view of a toy gun shown firing a sequence of water bursts.

In an air gun, the forward movement of the internal tube causes the L-shaped member flange 219'" to contact the forward camming surface 233, as shown in phantom lines in FIG. 22, and thus force the remaining indexing rotation of the magazine as the flange once again resides within the forward portion 234, as shown initially in FIG. 21. Again, the internal tube and sealing member may continue to reciprocate as long as the trigger is disengaged and there is sufficient fluid pressure. In a water gun, the movement of the L-shaped member also reciprocates sleeve 419, as shown in FIG. 29. This reciprocating movement of the sleeve resembles the recoil action of a machine gun.

Figure 27:
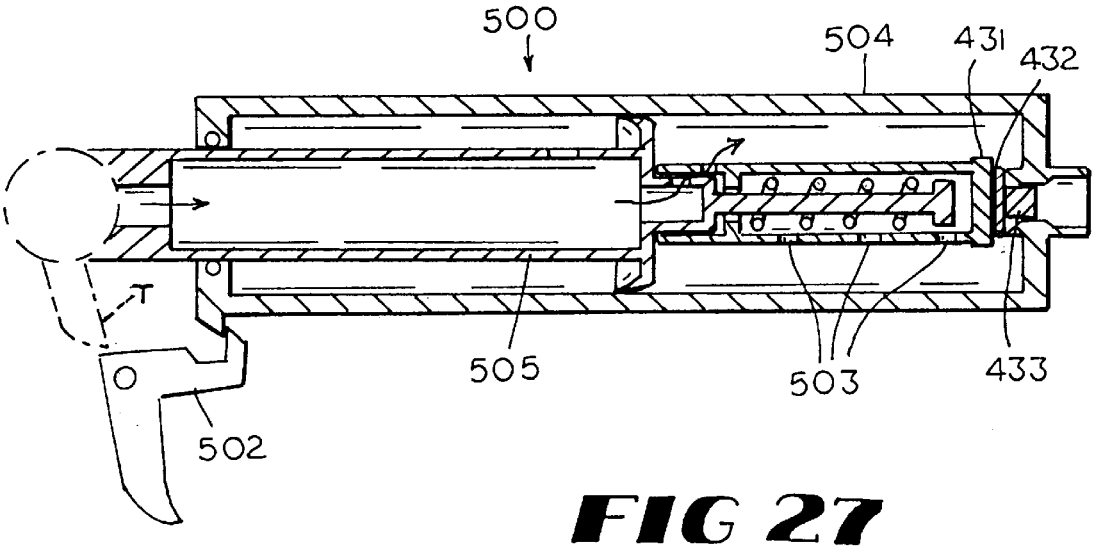
FIGS. 27–28 are a sequence of side views, shown in partial cross-section, of a portion of the interior components in another preferred embodiment, which show in sequence, the actuation of the fluid pulsator controlling the release of pressurized fluids.
Figure 28:
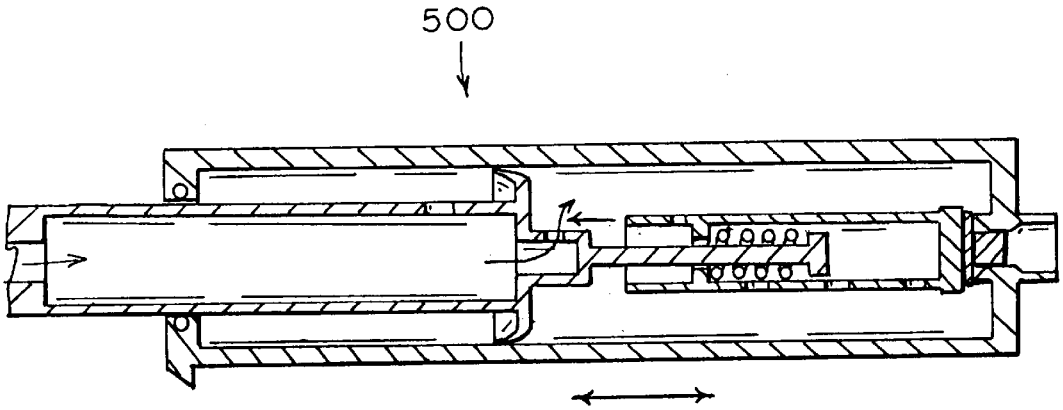

Referring next to FIGS. 27–28, there is shown the internal components of a fluid pulsator 500 in another preferred embodiment, although similar to that previously described in reference to FIGS. 23–26. Here however, the fluid is introduced through the internal tube 505 and it is the housing 504 that moves relative to the stationary internal tube 505, although this embodiment may be easily adapted so that the internal tube moves while the housing remains stationary. Nevertheless, the components thereof act and function similarly to those previously described. It should also be noted that a pressure release opening 503, or series of openings, extends through the sealing member to release fluid pressure within the sealing member as the post 422 moves therein.

A distinct advantage of the present invention is the configuration of the sealing head 431. Prior art sealing heads did not include the second portion. As such, as the sealing head would move slightly away from the fluid outlet 410 the fluid would rush between the small space between the sealing head and the housing defining the fluid outlet and into the larger space of the fluid outlet. This rushing of fluid into a larger space creates a low pressure cell in the area of the outlet which tends to pull the sealing head back into sealing engagement with the housing. Thus, the sealing head would flutter which would hamper the quick and precise release of the seal. In the present invention, the second portion 433 remains within the fluid outlet 410 as the sealing head moves rearward and separates from the housing. Thus, an additional fluid pressure is exerted upon the forward facing surface of the sealing head first portion 432 which causes the sealing member to move rearward with greater force prior to the final separation of the sealing member second portion 433 and housing. Also, the tapering of the fluid outlet causes a greater flow of fluid between the sealing head and housing with relative movement of the sealing head.

Figure 30:
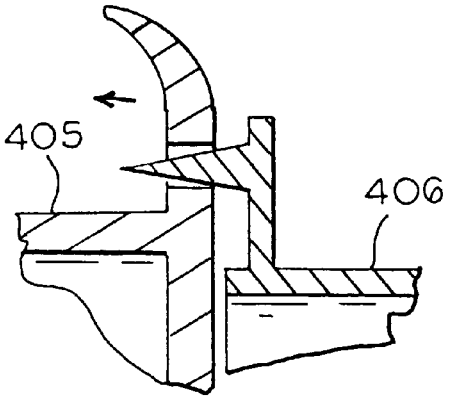
FIG. 30 is a cross-sectional view of a variable flow fluid valve in an alternative embodiment.

It should be understood that in the embodiments of FIGS. 23–26 and 27–28 the pressurized fluid may be directed into the pulsator without the use of a pressure tank 15, as shown in reference to FIGS. 6–9. As such, the pulsator may be coupled directly to a pump. It should also be understood that internal tube fluid outlet 421, with or without adjacent opening 424, varies the flow of fluid passing therethrough in relation to the relative positions of the internal tube and sealing member, and as such may be referred to as variable flow valve means. However, the present invention is not limited to this embodiment of a variable flow valve and may include many other types of mechanical valves, for example that of the tapered needle type valve shown in FIG. 30, or methods of creating a flow path between the forward and rearward fluid pressure chambers, such as an imperfect seal between the housing and internal tube or a passage through the internal tube. It should be understood that as an alternative to the mechanical trigger shown herein the trigger T may also be in the form of a fluid control valve or regulator, previously described or shown in phantom lines in FIG. 27, which controls the flow of fluids passing through the fluid inlet 409 or internal tube 505.

Figure 31:
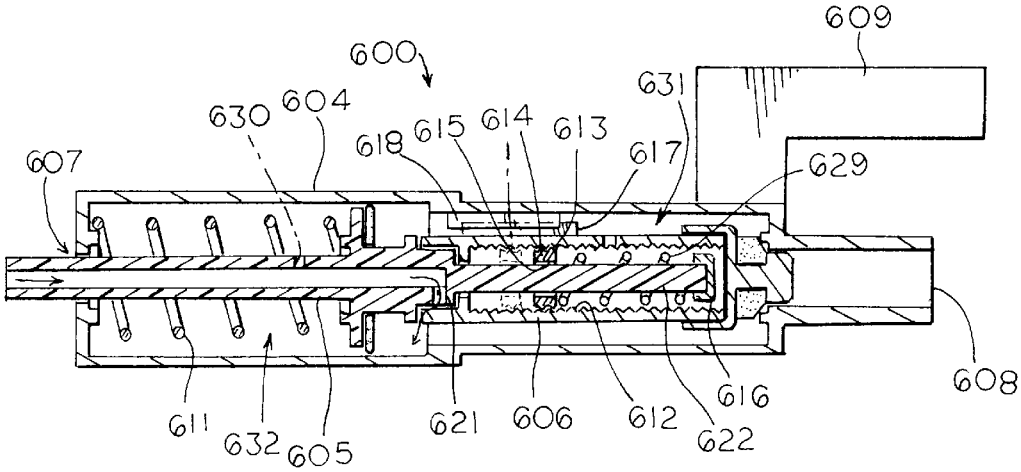
FIGS. 31–33 are a sequence of side views, shown in partial cross-section, of a portion of the interior components in another preferred embodiment, which show in sequence, the actuation of the fluid pulsator controlling the release of pressurized fluids.
Figure 32:
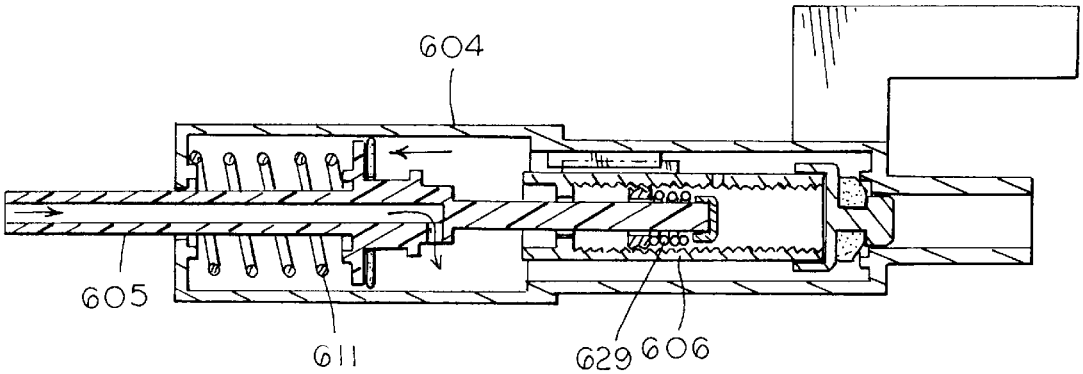
Figure 33:
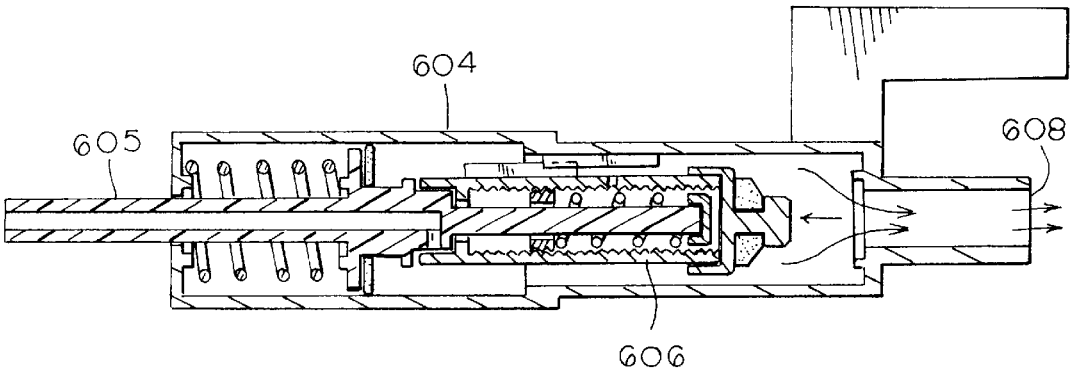

Referring next to FIGS. 31–33, there is shown the internal components of a fluid pulsator 600 in another preferred embodiment, although similar to that previously described in reference to FIGS. 27–28. These figures correspond to the actuation described in detail in FIGS. 23–26. Here again, and housing 604 has an internal tube opening 607 and a fluid outlet 608, and the fluid is introduced through the internal tube or plunger 605. The housing 604 moves relative to the stationary internal tube 605, although this embodiment may be easily adapted so that the internal tube moves while the housing remains stationary. The internal tube 605 has a sealing head 610 with a conventional seal adjacent thereto which divides the interior of the housing into a forward pressure chamber 631 and a rearward pressure chamber 632. The pulsator is shown with a magazine indexing arm 609 similar to that previously shown, which is present only when the pulsator is used in conjunction with an compressed air gun having a magazine and is not used in connection with water guns.

In addition to the previously recited components, this embodiment includes an internal tube biasing spring 611 for biasing the internal tube 605 to its forward position and means for adjustably actuating the movement of the movable sealing member 606 in direct relationship to the distance traveled or position of the internal tube 605 relative to the housing. To accomplish this adjustable actuation the internal surface of sealing member 606 is provided with internal threads 612 configured to correspond with the external threads 613 of an annular spring stop 614 having an opening 615 therethrough through which post 622 movably extends. The external surface of the sealing member 606 is also provided with a outwardly extending flange 617 configured to abut laterally with an inwardly extending flange 618 extending from the internal surface of the housing 604 to prevent rotation of the sealing member 606 relative to the housing. With this construction the manual rotation of the housing 604 causes the spring stop 614 to threadably move along the longitudinal axis of the sealing member 606 thereby varying the distance between the spring stop 614 and the end stop 615 of the post 622. FIG. 31 shows the spring stop 614, depicted in phantom lines in an alternative position along the internal tube.

It should be understood that with the spring stop 614 positioned distally from the post end stop 616 the internal tube must move a relatively large distance relative to the housing before the spring 629 fully compresses, as shown in FIGS. 32 and 33, and the sealing member is moved from its sealing position towards its unsealing position, i.e. the sealing member is actuated, as shown in FIG. 33. Conversely, should the spring stop 614 be positioned proximal to the post end stop 616 the internal tube 605 need only move a relatively short distance before the spring 611 is compressed and the sealing member 606 is actuated. A short distance of travel of the internal tube allows the pulsator to be actuated quicker than with a long distance of travel. Thus, one may adjust the pulse rate or cycling rate of the pulsator, and thus the fluid therefrom, by adjusting the position of the spring stop through rotation of the housing.

Again, it should be understood that in the embodiments of FIGS. 31–33 the pressurized fluid may be directed into the pulsator without the use of a pressure tank 15, as shown in reference to FIGS. 6–9. As such, the pulsator may be coupled directly to a pump. It should also be understood that internal tube fluid outlet 621 varies the flow of fluid passing therethrough in relation to the relative positions of the internal tube and sealing member, and as such may be referred to as variable flow valve means. However, the present invention is not limited to this embodiment of a variable flow valve and may include many other types of mechanical valves, for example that of the tapered needle type valve shown in FIG. 30, or methods of creating a flow path between the forward pressure chamber 631 and rearward pressure chamber 632, such as an imperfect seal between the housing and internal tube or a passage through the internal tube. It should be understood that this embodiment may work with either a mechanical trigger adapted to engage the housing or a fluid controlling trigger which controls the flow of fluid into the pulsator.

Lastly, it should be understood that as an alternative to the internal tube biasing spring 611 shown in the drawings the internal tube may include a fluid exit 630 in fluid communication with the rearward fluid pressure chamber. This modification replaces the biasing force provided by the internal tube biasing spring 611 with a biasing force provided by pressurized fluid within the rearward fluid pressure chamber, as previously described in reference to FIGS. 23–26.

While this invention has been described in detail with particular reference to the preferred embodiments thereof, it should be understood that many modifications, additions and deletions, in addition to those expressly recited, may be made thereto without departure from the spirit and scope of invention as set forth in the following claims.

We claim:

1. A toy gun comprising:

a plurality of launch tubes in which a plurality of projectiles may be loaded;

pressurized air means for providing a supply of pressurized air; and an air pulsator in fluid communication with said pressurized air means, said air pulsator having a tubular housing with an outlet in fluid communication with said launch tubes, a plunger mounted within said tubular housing, said plunger and said housing cooperating for reciprocal movement of said plunger relative to said housing between a forward position and a rearward position, said plunger having a sealing head in sealing engagement with said tubular housing, said tubular housing and said plunger defining a rearward chamber and a forward chamber separated from each other by said plunger sealing head, said rearward chamber being in fluid communication with said pressurized air means, a movable seal coupled to said plunger for reciprocal movement between a sealing position sealing said housing outlet and an unsealing position unsealing said housing outlet, adjustable actuation means for adjustably actuating the movement of said movable seal from said sealing position to said unsealing position in response to the movement of said plunger a select distance relative to said housing, and biasing means for biasing said plunger towards its forward position, whereby pressurized air flowing into the forward chamber causes the plunger to move away from the housing outlet towards its rearward position and against the biasing force of the biasing means and whereby the movement of the plunger a select distance determined by the adjustable actuation means causes the moveable seal to move to its unsealing position thereby allowing the pressurized air within the forward chamber to escape through the housing outlet, and whereby the release of pressurized air within the forward chamber allows the biasing force of the biasing means to move the plunger to its forward position thereby forcing the moveable seal back to its sealing position.

2. The toy gun of claim 1 further comprising air flow regulating means for regulating the flow of pressurized air from said pressurized air means to said forward chamber.

3. The toy gun of claim 1 further comprising a variable flow valve which variably controls the flow rate of air between said rearward chamber and said forward chamber in relation to the position of said plunger.

4. The toy gun of claim 2 wherein said air flow regulating means includes a trigger.

5. The toy gun of claim 4 wherein said trigger controls the flow of air from said pressurized air means to said pulsator.

6. The toy gun of claim 1 wherein said pressurized air means comprises an air pump.

7. The toy gun of claim 6 wherein said pressurized air means further comprises a pressure tank in fluid communication with said air pump and said air pulsator.

8. The toy gun of claim 1 wherein said biasing means comprises a spring.

9. The toy gun of claim 1 wherein said biasing means comprises pressurized air from said pressurized air means.

10. The toy gun of claim 1 wherein said adjustable actuation means comprises limiting means for allowing a limited distance of travel of said plunger between said forward position and said rearward position.

11. The toy gun of claim 10 wherein said limiting means comprises a post extending from said plunger, a first stop coupled to said post, a second stop coupled to said movable seal, and a spring extending between said first stop and said second stop.

12. The toy gun of claim 11 wherein said first stop is movably coupled to said post.

13. The toy gun of claim 11 wherein said second stop is movably coupled to said movable seal.

14. The toy gun of claim 3 wherein said variable flow valve comprises an air passage through said plunger in fluid communication with said pressurized air means, said air passage having an air exit in fluid communication with said forward chamber, and a fluid restricting member extending from said movable seal configured to overlay said air exit with said plunger in its rearward position and said seal in its unsealing position.

15. The toy gun of claim 14 wherein said variable flow valve is configured to restrict air flow through said plunger passage air exit with said movable seal in its unsealing position and the plunger in its rearward position and configured to allow substantially unrestricted air flow through said plunger passage air exit with said movable seal in its sealed position and said plunger positioned between its forward position and its rearward position.

16. The toy gun of claim 1 wherein a magazine comprises said plurality of launch tubes, wherein the position of said plunger is substantially fixed and said housing reciprocates back and forth relative said plunger, and wherein said housing includes an indexing pawl adapted to engage and index said magazine.

17. A fluid pulsator adapted to be coupled with a source of pressurized fluid comprising:

a tubular housing with an outlet, a plunger mounted within said tubular housing, said plunger and said housing being reciprocally moveable relative to each other for reciprocal movement of said plunger between a forward position and a rearward position, said plunger having a sealing head in sealing engagement with said tubular housing, said tubular housing and said plunger defining a rearward chamber and a forward chamber separated from each other by said plunger sealing head, said rearward chamber being in fluid communication with the source of pressurized fluid, a movable seal coupled to said plunger for reciprocal movement between a sealing position sealing said housing outlet and an unsealing position unsealing said housing outlet, adjustable actuation means for adjustably actuating the movement of said movable seal from said sealing position to said unsealing position in response to the movement of said plunger a selected distance, and biasing means for biasing said plunger towards its forward position, whereby pressurized air flowing into the forward chamber causes the plunger to move away from the housing outlet and whereby the movement of the plunger a select distance determined by said adjustable actuation means causes the moveable seal to move to its unsealing position thereby allowing the pressurized air within the forward chamber to escape through the housing outlet, and whereby the release of pressurized air within the forward chamber allows the biasing force of said biasing means to move the plunger to its forward position thereby forcing the moveable seal to its sealing position.

18. The fluid pulsator of claim 17 further comprising fluid flow regulating means for regulating the flow of pressurized fluid from the source of pressurized fluid to said forward chamber.

19. The fluid pulsator of claim 17 further comprising a variable flow valve which variably controls the flow rate of fluid between said rearward chamber and said forward chamber in relation to the position of said plunger.

20. The fluid pulsator of claim 18 wherein said fluid flow regulating means includes a trigger.

21. The fluid pulsator of claim 17 wherein said biasing means comprises a spring.

22. The fluid pulsator of claim 17 wherein said biasing means comprises pressurized fluid from the source of pressurized fluid.

23. The fluid pulsator of claim 17 wherein said adjustable actuation means comprises limiting means for allowing a limited distance of travel of said plunger between said forward position and said rearward position.

24. The fluid pulsator of claim 23 wherein said limiting means comprises a post extending from said plunger, a first stop coupled to said post, a second stop coupled to said movable seal, and a spring extending between said first stop and said second stop.

25. The fluid pulsator of claim 24 wherein said first stop is movably coupled to said post.

26. The fluid pulsator of claim 24 wherein said second stop is movably coupled to said movable seal.

27. The fluid pulsator of claim 19 wherein said variable flow valve comprises an air passage through said plunger in fluid communication with the source of pressurized fluid, said air passage having an air exit in fluid communication with said forward chamber, and a fluid restricting member extending from said movable seal configured to overlay said air exit with said plunger in its rearward position and said seal in its unsealing position.

28. The fluid pulsator of claim 27 wherein said variable flow valve is configured to restrict fluid flow through said plunger passage fluid exit with said movable seal in its unsealing position and the plunger in its rearward position and configured to allow substantially unrestricted fluid flow through said plunger passage fluid exit with said movable seal in its sealed position and said plunger positioned between its forward position and its rearward position.

29. A fluid expelling toy gun comprising:

pressurized fluid means for providing a supply of pressurized fluid;

a fluid pulsator coupled to said pressurized fluid means, said fluid pulsator having a tubular housing with a forward fluid outlet and a rearward opening opposite said fluid outlet, a stationary plunger having an elongated shaft extending through said housing rearward opening and a sealing head positioned within said housing in sealing engagement therewith, said housing adapted to reciprocate upon said stationary plunger between a forward position and a rearward position, said tubular housing and said plunger defining a rearward chamber and a forward chamber separated from each other by said plunger sealing head, said rearward chamber being in fluid communication with the pressurized fluid means and said forward chamber being in fluid communication with ambience, a movable seal coupled to said plunger for reciprocal movement between a sealing position sealing said housing outlet and an unsealing position unsealing said housing outlet, and biasing means for biasing said plunger towards its forward position, whereby pressurized fluid flowing into the forward chamber causes the housing to move to its forward position and whereby the forward movement of the housing a select distance causes the seal to move to its unsealing position thereby allowing the pressurized fluid within the forward chamber to escape through the housing outlet, and whereby the release of pressurized fluid within the forward chamber allows the biasing force of the biasing means to move the housing to its rearward position thereby forcing the moveable seal to its sealing position.

30. The fluid expelling toy gun of claim 29 further comprising a magazine adapted to hold a plurality of projectiles, and wherein said forward fluid outlet is in fluid communication with said magazine.

31. The fluid expelling toy gun of claim 30 wherein said pressurized fluid means includes a pump and a pressure tank in fluid communication with said pump.

32. The fluid expelling toy gun of claim 29 further comprising adjustable actuation means for adjustably actuating the movement of said movable seal from said sealing position to said unsealing position in response to the movement of said plunger a selected distance.

33. The toy gun of claim 29 wherein said biasing means comprises a spring.

34. The toy gun of claim 29 wherein said biasing means comprises pressurized fluid from said pressurized fluid means.

35. The toy gun of claim 32 wherein said adjustable actuation means comprises limiting means for allowing a limited distance of travel of said plunger between said forward position and said rearward position.

36. The toy gun of claim 35 wherein said limiting means comprises a post extending from said plunger, a first stop coupled to said post, a second stop coupled to said movable seal, and a spring extending between said first stop and said second stop.

37. The toy gun of claim 36 wherein said first stop is movably coupled to said post.

38. The toy gun of claim 36 wherein said second stop is movably coupled to said movable seal.

39. The toy gun of claim 30 wherein a magazine comprises said plurality of launch tubes, wherein the position of said plunger is substantially fixed and said housing reciprocates back and forth relative said plunger, and wherein said housing includes an indexing pawl adapted to engage and index said magazine.

* * * * *